US010851548B2

(12) United States Patent
Ochi

(10) Patent No.: US 10,851,548 B2
(45) Date of Patent: Dec. 1, 2020

(54) WALL STRUCTURE FOR BUILDING, ATTACHMENT APPARATUS, AND BOARD MATERIAL CONSTRUCTION METHOD

(71) Applicant: NICHIHA CORPORATION, Nagoya (JP)

(72) Inventor: Yoshio Ochi, Nagoya (JP)

(73) Assignee: NICHIHA CORPORATION, Nagoya (JP)

( * ) Notice: Subject to any disclaimer, the term of this patent is extended or adjusted under 35 U.S.C. 154(b) by 0 days.

(21) Appl. No.: 16/487,412

(22) PCT Filed: Jun. 18, 2018

(86) PCT No.: PCT/JP2018/023060
§ 371 (c)(1),
(2) Date: Aug. 20, 2019

(87) PCT Pub. No.: WO2018/235760
PCT Pub. Date: Dec. 27, 2018

(65) Prior Publication Data

US 2020/0071934 A1 Mar. 5, 2020

(30) Foreign Application Priority Data

Jun. 21, 2017 (JP) ..... 2017-121125
Dec. 27, 2017 (JP) ..... 2017-251901

(51) Int. Cl.
*E04F 13/08* (2006.01)

(52) U.S. Cl.
CPC ..... *E04F 13/081* (2013.01); *E04F 13/0826* (2013.01)

(58) Field of Classification Search
CPC ..... E04F 13/081; E04F 13/0826; E04B 2/56
See application file for complete search history.

(56) References Cited

U.S. PATENT DOCUMENTS 5,755,416 A 5/1998 Leek
6,484,465 B2 * 11/2002 Higgins ..... E04F 13/081 52/235

(Continued)

FOREIGN PATENT DOCUMENTS

DE 8501840 U1 3/1985
DE 29920358 U1 * 2/2000

(Continued)

OTHER PUBLICATIONS

U.S. Appl. No. 29/694,219, filed Jun. 7, 2019.

(Continued)

*Primary Examiner* — Patrick J Maestri
(74) *Attorney, Agent, or Firm* — Birch, Stewart, Kolasch & Birch, LLP

(57) ABSTRACT

Provided are a wall structure for a building, an attachment apparatus, and a board material construction method, according to which construction is simple and fast, and a board material can be stably supported. A bracket includes: a first portion 110; a second portion 120; a first side wall portion 101 that extends continuously from at least a portion of one side edge 111 of the first portion 110 to at least a portion of one side edge 121 of the second portion 120, and protrudes toward a narrow angle α1 side; a second side wall portion 102 that extends continuously from at least a portion of another side edge 112 of the first portion 110 to at least a portion of another side edge 122 of the second portion 120, and protrudes toward the narrow angle α1; and a mounting portion 125 that is provided on the second portion 120. A first support body 30 includes: a first joining portion 31 that is to be mounted on the mounting surface 126 of the mounting portion 125; and a second joining portion 32. A fastening member includes a first drill screw 91 that pen- (Continued)

etrates through and fastens the mounting portion 125 and the first joining portion 31 to each other.

16 Claims, 22 Drawing Sheets

(56) References Cited

U.S. PATENT DOCUMENTS

| | | | |
|---|---|---|---|
| 6,612,087 | B2 | 9/2003 | diGirolamo et al. |
| 6,830,405 | B2 | 12/2004 | Watanabe |
| 7,104,024 | B1 | 9/2006 | diGirolamo et al. |
| 7,503,150 | B1 | 3/2009 | diGirolamo et al. |
| 7,926,230 | B2 | 4/2011 | Yoshida et al. |
| 8,555,592 | B2 | 10/2013 | Daudet et al. |

FOREIGN PATENT DOCUMENTS

| | | | | |
|---|---|---|---|---|
| DE | 20 2011 100 168 | U1 | 8/2012 | |
| EP | 0 008 272 | A | 2/1980 | |
| EP | 2309072 | A1 * | 4/2011 | ..... E04F 13/081 |
| FR | 3 012 489 | A1 | 5/2015 | |
| JP | D337098 | | 10/1971 | |
| JP | D389671 | | 12/1974 | |
| JP | D389672 | | 12/1974 | |
| JP | 53-22972 | | 6/1978 | |
| JP | D483643 | | 9/1978 | |
| JP | D484077 | | 9/1978 | |
| JP | D484077-1 | | 10/1978 | |
| JP | D489869 | | 12/1978 | |
| JP | D1020617 | S | 9/1988 | |
| JP | 6-22038 | Y2 | 6/1994 | |
| JP | 9-32167 | A | 2/1997 | |
| JP | 10-205100 | A | 8/1998 | |
| JP | 11-324157 | A | 11/1999 | |
| JP | 2000-336768 | A | 12/2000 | |
| JP | 2002-38631 | A | 2/2002 | |
| JP | 2002-339473 | A | 11/2002 | |
| JP | D1164014 | S | 1/2003 | |
| JP | 2004-150189 | A | 5/2004 | |
| JP | D1213966 | S | 8/2004 | |
| JP | 2005-23746 | A | 1/2005 | |
| JP | 2006 52582 | A | 2/2006 | |
| JP | 2007-211511 | A | 8/2007 | |
| JP | 3137086 | U | 11/2007 | |
| JP | 2007-321510 | A | 12/2007 | |
| JP | D1330668 | S | 5/2008 | |
| JP | 2009-35896 | A | 2/2009 | |
| JP | D1387698 | S | 5/2010 | |
| JP | 2010-255234 | A | 11/2010 | |
| JP | D1469363 | S | 5/2013 | |
| JP | D1478151 | S | 9/2013 | |
| JP | D1478152 | S | 9/2013 | |
| JP | 2015-169041 | A | 9/2015 | |
| JP | D1551096 | S | 6/2016 | |
| JP | D1568631 | S | 2/2017 | |
| JP | D1586221 | S | 9/2017 | |
| JP | D1598491 | S | 2/2018 | |
| WO | WO 96/31667 | A1 | 10/1996 | |
| WO | WO 2005/090706 | A1 | 9/2005 | |

OTHER PUBLICATIONS

U.S. Appl. No. 29/694,188, filed Jun. 7, 2019.

International Search Report for PCT/JP2018/023060 (PCT/ISA/210) dated Sep. 4, 2018.

European Patent Office Communication and extended search report issued in the corresponding European Patent Application No. 18819733.9 dated Oct. 5, 2020.

* cited by examiner

WALL STRUCTURE FOR BUILDING, ATTACHMENT APPARATUS, AND BOARD MATERIAL CONSTRUCTION METHOD

TECHNICAL FIELD

The present invention relates to a wall structure for a building.

BACKGROUND ART

Patent Documents 1 to 3 disclose a conventional wall structure for a building. In the wall structure disclosed in Patent Document 1, multiple bracket base materials that extend in the left-right direction are arranged on a wall surface of a structural body. Multiple brackets are fixed to the bracket base materials. Also, multiple vertical furring strips that extend in the up-down direction along the wall surface are arranged extending across the multiple brackets. Furthermore, multiple board materials are attached to the vertical furring strips, and the board materials cover the wall surface. With this wall structure, when unevenness occurs in the wall surface, a countermeasure for preventing unevenness between the board materials attached to the structural body is needed.

In this respect, in the wall structure disclosed in Patent Document 2, a bolt fixing hole is provided through a mounting portion of a base member, and an elongated hole is provided through a slide portion of a slide member. Then, when a male screw is inserted through the bolt fixing hole and the elongated hole and screwed into a slide member fixing nut, unevenness in the wall surface can be adjusted by shifting the slide portion with respect to the mounting portion.

Also, in the wall structure disclosed in Patent Document 3, a bolt fixing hole is provided through a standing portion of a first bracket member, and an elongated hole is provided through a slide portion of a second bracket member. Then, when a bolt is inserted through the bolt fixing hole and the elongated hole and is screwed into a nut, unevenness of the wall surface can be adjusted by shifting the slide portion with respect to the standing portion.

CITATION LIST

Patent Documents

Patent Document 1: JP 2002-339473A
Patent Document 2: JP 2007-211511A
Patent Document 3: JP 3137086U

SUMMARY OF INVENTION

Technical Problem

However, with the wall structures disclosed in Patent Documents 2 and 3, multiple members are combined, and thus the structure in which the relative positions are adjusted with the elongated hole is complicated and has many steps during construction, and therefore construction is troublesome. Also, there is a possibility that looseness will occur between the multiple members, and in this case, there is a risk that the board materials can no longer be stably supported.

The present invention was made in view of the foregoing conventional circumstances, and a problem to be solved is to provide a wall structure for a building, an attachment apparatus, and a board material construction method, according to which construction is simple and fast, and board materials can be stably supported.

Solution to Problem

A wall structure for a building according to a first aspect of the present invention includes: a structural body forming a wall surface; a plurality of brackets arranged on the wall surface; a plurality of first support bodies that extend in a first direction along the wall surface and are arranged extending across at least two of the brackets; fastening members configured to fasten the brackets and the first support bodies to each other; and a plurality of board materials configured to be attached directly or indirectly to a side of at least two of the first support bodies that is opposite to the wall surface, and to cover the wall surface. The brackets each include: a first portion including a fixing portion configured to be fixed to the structural body; a second portion that is bent at an approximate right angle from the first portion and extends away from the fixing portion; a first side wall portion that extends continuously from at least a portion of one side edge of the first portion to at least a portion of one side edge of the second portion, and protrudes toward a narrow angle side of an angle formed by the first portion and the second portion; a second side wall portion that extends continuously from at least a portion of another side edge of the first portion to at least a portion of another side edge of the second portion, and protrudes toward the narrow angle side; and a mounting portion including a mounting surface that is provided on the second portion and faces a side opposite to the side to which the first side wall portion and the second side wall portion protrude. The first support bodies each include: a first joining portion configured to be mounted on the mounting surface; and a second joining portion on which the board materials are to be arranged directly or indirectly. The fastening members include first drill screws configured to fasten the mounting portions and the first joining portions to each other in a direction perpendicular to the mounting surface.

In the wall structure for a building according to the first aspect of the present invention, highly-rigid brackets each having first and second side wall portions that extend continuously from at least portions of both side edges of the first portion to at least portions of both side edges of the second portion are used. For this reason, unevenness in the wall surface of the structural body can be adjusted when the first joining portion of the first support body is mounted on the mounting surface, and the mounting portion of the bracket and the first joining portion of the first support body can be fastened to each other using the first drill screw at that position.

That is, even if a significant load is applied to the bracket when the first drill screw fastens the mounting portion and the first joining portion to each other, the bracket reinforced by the first and second side wall portions can withstand the load. For this reason, with this wall structure, the unevenness adjustment of the wall surface and the arrangement of the first support body can be implemented in the same step, and therefore construction is simpler and faster.

Also, with this wall structure, due to using a simple fastening configuration, looseness is not likely to occur between the bracket and the first support body. Furthermore, deformation caused by the bracket supporting the weight of the board material over a long period can be suppressed by the first and second side wall portions.

Accordingly, with the wall structure for a building of the first aspect of the present invention, construction is simple and fast, and the board material can be stably supported.

Here, the configuration in which "the board material is attached directly to the side of at least two of the first support bodies that is opposite to the wall surface, and the board material is arranged directly on the second joining portions of the first support bodies" specifically means a configuration in which the board material is arranged on the second joining portions without a support body other than the first support bodies being interposed, and the board material is attached directly to the first support bodies using a fastening member, an attachment tool, or the like, such as a screw. According to this configuration, by not using a support body other than the first support bodies to attach the board material, it is possible to realize a reduction of the number of parts and simplification of the task due to a reduction of the number of steps.

On the other hand, the configuration in which "the board material is attached indirectly to the side of at least two first support bodies that is opposite to the wall surface and the board material is arranged indirectly on the second joining portions of the first support bodies" specifically means a configuration in which the board material is arranged on the second joining portions with a support body other than the first support bodies interposed, the other support body is attached to the first support bodies using a fastening member such as a screw, and furthermore, the board material is attached to the other support body using a fastening member such as a screw, an attachment tool, or the like. There is at least one other support body. According to this configuration, by using the support body other than the first support bodies, the unevenness adjustment of the wall surface can be implemented even more preferably and the board material can be supported even more stably.

As a second aspect of the present invention, it is desirable that the wall structure for a building includes a plurality of second support bodies that extend in a second direction intersecting the first support bodies along the wall surface and are arranged extending across at least two of the first support bodies. It is desirable that the second support bodies are arranged on the second joining portions. Also, it is desirable that the board materials are attached to at least two of the second support bodies.

In this case, using the first support body and the second support body, which intersect each other, the unevenness adjustment of the wall surface can be implemented even more preferably, and the board material can be supported even more stably.

As a third aspect of the present invention, it is desirable that the brackets each include a protruding portion that is provided between the first side wall portion and the second side wall portion, extends continuously from at least a portion of the first portion to at least a portion of the second portion, and protrudes toward the narrow angle side.

In this case, the first portion and second portion of the bracket and the connection portions of the first portion and second portion can be reinforced by the protruding portion. For this reason, the protrusion lengths of the first side wall portion and the second side wall portion can be suppressed to be small. Accordingly, if the heat insulating material is arranged around the bracket, it is possible to suppress a case in which a gap occurs between the narrow angle side of the second portion of the bracket and the heat insulating material using the first side wall portion and the second side wall portion.

As a fourth aspect of the present invention, it is desirable that the protruding portion extends to the approximate center of the second portion. Also, it is desirable that the mounting surface is a flat surface formed in a range of the second portion that is farther from the first portion than the protruding portion.

In this case, the mounting surface is a flat surface due to being formed in a range of the second portion in which the protruding portion does not exist, and therefore the first joining portion of the first support body can be reliably mounted on the mounting surface, and the mounting portion and the first joining portion can be reliably fastened to each other using the first drill screw.

As a fifth aspect of the present invention, it is desirable that a first height to which the protrusion portion protrudes with respect to the mounting surface is set to be less than or equal to a second height to which the first side wall portion and the second side wall portion protrude with respect to the mounting surface.

In this case, due to the first height being set to be less than or equal to the second height, the second height can be reduced according to the reinforcing effect of the protruding portion on the bracket, and it is possible to suppress a case in which the first and second side wall portions and the protruding portion hinder construction. Also, if the heat insulating material is arranged around the bracket, it is possible to effectively suppress a case in which a gap occurs between the heat insulating material and the bracket near the first and second side wall portion on the narrow angle side of the second portion of the bracket.

As a sixth aspect of the present invention, it is desirable that the mounting portion is provided with a main elongated hole that extends away from the fixing portion.

In this case, when the mounting portion of the bracket and the first joining portion of the first support body are to be fastened to each other, the first support body can be temporarily fastened to the mounting portion by inserting the first drill screw into the main elongated hole of the mounting portion and thereafter shallowly screwing the first drill screw into the first joining portion. Then, in this state, the mounting portion and the first joining portion can be reliably fastened to each other by positioning the first support body through shifting in a direction of moving away from the fixing portion or the opposite direction, and thereafter completely screwing the first drill screw into the first joining portion. As a result, the positioning of the first support body for adjusting the unevenness of the wall surface can be performed precisely and easily, and thus simplification of the task can be realized.

As a seventh aspect of the present invention, it is desirable that the mounting portion is provided with at least one main circular hole arranged at a position away from the main elongated hole in a direction intersecting a longitudinal direction of the main elongated hole.

In this case, the first drill screw is inserted into the main elongated hole of the mounting portion and positioning adjustment of the first support body is performed, and the mounting portion and the first joining portion are reliably fastened to each other, and thereafter the mounting portion and the first joining portion can be even more reliably fastened to each other by inserting another first drill screw into the main circular hole of the mounting portion and screwing the other first drill screw into the first joining portion. At this time, the other first drill screw need not drill a pilot hole in the mounting portion, and therefore the task of fastening using the other first drill screw can be performed easily.

As an eighth aspect of the present invention, it is desirable that the wall structure for a building includes an extension member configured to be arranged between the mounting portion of the bracket and the first joining portion of the first support body. It is desirable that the extension member includes: an extension mounting portion that is configured to be mounted on the mounting surface, extends away from the first portion, and includes an extension mounting surface that faces the same side as the mounting surface such that the first joining portion is mounted thereon; a first extension side wall portion that protrudes in the same direction as the first side wall portion from one side edge of the extension mounting portion, and is adjacent to the first side wall portion; and a second extension side wall portion that protrudes in the same direction as the second side wall portion from another side edge of the extension mounting portion, and is adjacent to the second side wall portion. Also, it is desirable that the fastening members include: a second drill screw for fastening the mounting portion and the extension mounting portion to each other in a direction perpendicular to the mounting surface; and a third drill screw for fastening the extension mounting portion and the first joining portion to each other in a direction perpendicular to the extension mounting surface.

In this case, even if unevenness in the wall surface is significant, the unevenness is adjusted using the extension member, and then the bracket and the first support body can be fastened to each other. Accordingly, it is possible to reliably realize a case in which the first support body is arranged straight in a first direction, and as a result, the board material can be arranged on the structural body with high accuracy. Also, due to the first and second extension side wall portions sandwiching the first and second side wall portions, horizontal shifting of the extension member with respect to the mounting portion can be suppressed when the extension member slides in the direction toward or away from the wall surface, and when the second drill screw fastens the mounting portion and the extension mounting portion to each other. Furthermore, even if a significant load acts on the extension member when the second drill screw fastens the mounting portion and the extension mounting portion to each other, the extension member reinforced by the first and second extension side wall portions can withstand the load. Also, even if a significant load acts on the extension member when the third drill screw fastens the extension mounting portion and the first joining portion to each other, the extension member reinforced by the first and second extension side wall portions can withstand the load. As a result, unevenness in the wall surface can be adjusted and the first support body can be easily and strongly fastened to the bracket using the extension member and the second and third drill screws.

As a ninth aspect of the present invention, it is desirable that the extension mounting portion is provided with an auxiliary elongated hole that extends away from the first portion.

In this case, when the extension mounting portion of the extension member and the first joining portion of the first support body are fastened to each other, the first support body can be temporarily fastened to the extension mounting portion by inserting the third drill screw into the auxiliary elongated hole of the extension mounting portion and thereafter shallowly screwing the third drill screw into the first joining portion. Then, in that state, the extension mounting portion and the first joining portion can be reliably fastened to each other by positioning the first support body through shifting in the direction of moving away from the first portion or the opposite direction and thereafter completely screwing the third drill screw into the first joining portion. As a result, the positioning of the first support body for adjusting the unevenness of the wall surface can be performed precisely and easily, and thus simplification of the task can be realized.

As a tenth aspect of the present invention, it is desirable that the extension mounting portion is provided with at least one auxiliary circular hole arranged at a position away from the auxiliary elongated hole in a direction intersecting the longitudinal direction of the auxiliary elongated hole.

In this case, the third drill screw is inserted into the auxiliary elongated hole of the extension mounting portion, and positioning adjustment of the first support body is performed, whereupon the extension mounting portion and the first joining portion are reliably fastened to each other, and thereafter the extension mounting portion and the first joining portion can be even more reliably fastened to each other by inserting another third drill screw into the auxiliary circular hole of the extension mounting portion and screwing the other third drill screw into the first joining portion. At this time, the other third drill screw need not drill a pilot hole in the extension mounting portion, and therefore the task of fastening using the other third drill screw can be performed easily.

As an eleventh aspect of the present invention, it is desirable that the auxiliary elongated hole and the auxiliary circular hole are arranged at positions shifted with respect to the main elongated hole. Also, it is desirable that the auxiliary elongated hole and the auxiliary circular hole are arranged at positions shifted with respect to the main circular hole.

In this case, when the mounting portion of the bracket and the extension mounting portion of the extension member are fastened to each other, the extension member can be temporarily fastened to the mounting portion by inserting the second drill screw into the main elongated hole of the mounting portion and thereafter shallowly screwing the second drill screw into the extension mounting portion. Then, in this state, the mounting portion and the extension mounting portion can be reliably fastened to each other by positioning the extension member through shifting in the direction of moving away from the first portion or the opposite direction and thereafter completely screwing the second drill screw into the extension mounting portion. Thereafter, the mounting portion and the extension mounting portion can be even more reliably fastened to each other by inserting another second drill screw into the main circular hole of the mounting portion and screwing the other second drill screw into the extension mounting portion. At this time, the other second drill screw need not drill a pilot hole in the mounting portion, and therefore the task of fastening using the other second drill screw can be performed easily. The task of fastening with the third drill screw, using the auxiliary elongated hole and the auxiliary circular hole, is as described in the ninth and tenth aspects of the present invention. At this time, the auxiliary elongated hole and the auxiliary circular hole are arranged at positions shifted with respect to the main elongated hole, and the auxiliary elongated hole and the auxiliary circular hole are arranged at positions shifted with respect to the main circular hole, whereby the auxiliary elongated hole and the auxiliary circular hole do not hinder each other's effect. As a result, the positioning of the first support body for adjusting the unevenness of the wall surface can be performed even more precisely and easily, and thus further simplification of the task can be realized.

Also, in this case, when the first support body extends horizontally, that is, when the first direction is the horizontal direction, the following work procedure can also be used, with consideration given to ease of performing the task. That is, when the mounting portion of the bracket and the extension mounting portion of the extension member, which overlaps the mounting portion from above, are to be fastened to each other, the extension member can be temporarily fastened to the mounting portion by inserting the second drill screw into the auxiliary elongated hole of the extension mounting portion and thereafter shallowly screwing the second drill screw into the mounting portion. Then, in this state, the mounting portion and the extension mounting portion can be reliably fastened to each other by positioning the extension member through shifting in the direction of moving away from the first portion or the opposite direction and thereafter completely screwing the second drill screw into the mounting portion. Thereafter, the mounting portion and the extension mounting portion can be even more reliably fastened to each other by inserting another second drill screw into the auxiliary circular hole of the extension mounting portion and screwing the second drill screw into the mounting portion.

As a twelfth aspect of the present invention, it is desirable that the board materials each have a quadrilateral shape with four first to fourth end portions. It is desirable that in each of the board materials, the first end portion of the board material includes a first shiplap joining portion that is recessed from a back surface to a front surface of the board material and extends along the first end portion. It is desirable that the second end portion of the board material opposing the first end portion includes a second shiplap joining portion that is recessed from the front surface to the back surface of the board material and extends along the second end portion. It is desirable that the third end portion that intersects the first end portion and the second end portion of the board material includes a third shiplap joining portion that is recessed from the front surface to the back surface of the board material and extends along the third end portion. Also, it is desirable that the fourth end portion of the board material that opposes the third end portion includes a fourth shiplap joining portion that is recessed from the back surface to the front surface of the board material and extends along the fourth end portion.

In this case, the board material has a so-called "four-way shiplap structure", and a joining portion in one direction, such as a joining portion in vertical direction, is formed due to the first shiplap joining portion and the second shiplap joining portion overlapping. Also, a joining portion in another direction, such as a joining portion in a horizontal direction, is formed due to the third shiplap joining portion and the fourth shiplap joining portion overlapping. Accordingly, gaps between board materials that are adjacent in the vertical direction and the horizontal direction are not likely to occur. For this reason, the joining and waterproof property of the board materials can be ensured without using sealing or the like. Also, the quality of the appearance of the joining portions of the board materials is improved. Accordingly, it is possible to provide a high-quality wall structure for which construction is simple.

An attachment apparatus according to a thirteenth aspect of the present invention includes a bracket that can be arranged on a wall surface formed by a structural body. The bracket includes: a first portion including a fixing portion configured to be fixed to the structural body; a second portion that is bent at an approximate right angle from the first portion and extends away from the fixing portion; a first side wall portion that extends continuously from at least a portion of one side edge of the first portion to at least a portion of one side edge of the second portion, and protrudes toward a narrow angle side of an angle formed by the first portion and the second portion; a second side wall portion that extends continuously from at least a portion of another side edge of the first portion to at least a portion of another side edge of the second portion, and protrudes toward the narrow angle side; and a mounting portion including a mounting surface that is provided on the second portion and faces a side opposite to the side to which the first side wall portion and the second side wall portion protrude. The mounting portion is provided with a main elongated hole that extends away from the fixing portion. At least one main circular hole that is arranged at a position away from the main elongated hole in a direction intersecting the longitudinal direction of the main elongated hole.

According to the attachment apparatus of the thirteenth aspect of the present invention, it is possible to exhibit effects similar to those of the wall structure for a building of the first, second, sixth, and seventh aspects of the present invention.

As a fourteenth aspect of the present invention, it is desirable that the bracket includes a protrusion portion that is provided between the first side wall portion and the second side wall portion, extends continuously from at least a portion of the first portion to at least a portion of the second portion, and protrudes toward the narrow angle side.

In this case, it is possible to exhibit an effect similar to that of the wall structure for a building of the third aspect of the present invention.

As a fifteenth aspect of the present invention, it is desirable that the attachment apparatus includes an extension member configured to be used along with the bracket. It is desirable that the extension member includes: an extension mounting portion that includes an extension mounting surface and is to be mounted on the mounting surface; a first extension side wall portion that protrudes from one side edge of the extension mounting portion; and a second extension side wall portion that protrudes from another side edge of the extension mounting portion. It is desirable that the extension mounting portion is provided with an auxiliary elongated hole that extends in the longitudinal direction of the extension mounting surface, and at least one auxiliary circular hole that is arranged at a position away from the auxiliary elongated hole in a direction intersecting the longitudinal direction of the auxiliary elongated hole. Also, it is desirable that when the extension mounting portion of the extension member is mounted on the mounting surface of the bracket, the extension mounting surface faces the same side as the mounting surface, the first extension side wall portion is adjacent to the first side wall portion, and the second extension side wall portion is adjacent to the second side wall portion, the auxiliary elongated hole and the auxiliary circular hole are arranged at positions shifted with respect to the main elongated hole, and the auxiliary elongated hole and the auxiliary circular hole are arranged at positions shifted with respect to the main circular hole.

In this case, it is possible to exhibit an effect similar to that of the wall structure for a building of the eighth to eleventh aspects of the present invention.

A board material construction method according to a sixteenth aspect of the present invention is a board material construction method in which a board material is attached to a structural body forming a wall surface, using a bracket, a first support body, and a fastening member, the method including: a first step of arranging a plurality of the brackets on the wall surface; a second step in which a plurality of the first support bodies are arranged extending across at least two of the brackets, extending in a first direction along the wall surface; a third step of fastening the brackets and the first support bodies to each other using the fastening members; and a fourth step in which a plurality of the board materials are attached directly or indirectly to a side of at least two of the first support bodies that is opposite to the wall surface, and the board materials cover the wall surface. The bracket includes: a first portion that includes a fixing portion configured to be fixed to the structural body in the first step; a second portion that is bent at an approximate right angle from the first portion and extends away from the fixing portion; a first side wall portion that extends continuously from at least a portion of one side edge of the first portion to at least a portion of one side edge of the second portion, and protrudes toward a narrow angle side of an angle formed by the first portion and the second portion; a second side wall portion that extends continuously from at least a portion of another side edge of the first portion to at least a portion of another side edge of the second portion, and protrudes toward the narrow angle side; and a mounting portion including a mounting surface that is provided on the second portion and faces a side opposite to the side to which the first side wall portion and the second side wall portion protrude. The first support body includes: a first joining portion configured to be mounted on the mounting surface in the second step; and the second joining portion on which the board material is to be arranged directly or indirectly in the fourth step. The fastening member includes a first drill screw configured to fasten the mounting portion and the first joining portion to each other in a direction perpendicular to the mounting surface in the third step.

According to the board material construction method of the sixteenth aspect of the present invention, similarly to the wall structure for a building according to the first aspect of the present invention, construction is simple and fast, and the board material can be stably supported.

As a seventeenth aspect of the present invention, it is desirable that the fourth step includes: a fifth step of arranging a plurality of second support bodies in a manner extending across at least two of the first support bodies, the plurality of second support bodies extending in a second direction intersecting the first support bodies along the wall surface; and a sixth step of attaching the board materials to at least two of the second support bodies. Also, it is desirable that in the fifth step, the second support bodies are arranged on the second joining portions of the first support bodies.

In this case, it is possible to exhibit an effect similar to that of the wall structure for a building of the second aspect of the present invention.

As an eighteenth aspect of the present invention, it is desirable that the mounting portion is provided with a main elongated hole that extends away from the fixing portion. Also, it is desirable that in the third step, the first drill screw is inserted into the main elongated hole and thereafter is shallowly screwed into the first joining portion, then the first support body is positioned through shifting in a direction of moving away from the fixing portion or the opposite direction, and then the first drill screw is completely screwed into the first joining portion.

In this case, it is possible to exhibit an effect similar to that of the wall structure for a building of the sixth aspect of the present invention.

As a nineteenth aspect of the present invention, it is desirable that in the second step, an extension member is arranged between the mounting portion of the bracket and the first joining portion of the first support body. It is desirable that the extension member includes: an extension mounting portion that is configured to be mounted on the mounting surface, extends away from the first portion, and includes an extension mounting surface that faces the same side as the mounting surface and on which the first joining portion is to be mounted; a first extension side wall portion that protrudes in the same direction as the first side wall portion from one side edge of the extension mounting portion, and is adjacent to the first side wall portion; and a second extension side wall portion that protrudes in the same direction as the second side wall portion from another side edge of the extension mounting portion, and is adjacent to the second side wall portion. Also, it is desirable that in the third step, the fastening member fastens the mounting portion and the extension mounting portion to each other in a direction perpendicular to the mounting surface using a second drill screw, and the fastening member fastens the extension mounting portion and the first joining portion to each other in a direction perpendicular to the extension mounting surface using a third drill screw.

In this case, similarly to the wall structure for a building according to the eighth aspect of the present invention, unevenness of the wall surface can be adjusted and the first support body can be easily and strongly fastened to the bracket using the extension member and the second and third drill screws.

As a twentieth aspect of the present invention, it is desirable that the extension mounting portion is provided with an auxiliary elongated hole that extends away from the first portion. Also, it is desirable that in the third step, the third drill screw is inserted into the auxiliary elongated hole and thereafter shallowly screwed into the first joining portion, then the first support body is positioned through shifting in the direction of moving away from the first portion or the opposite direction, and then the third drill screw is completely screwed into the first joining portion.

In this case, it is possible to exhibit an effect similar to that of the wall structure for a building of the ninth aspect of the present invention.

Advantageous Effects of Invention

With the wall structure for a building, the attachment apparatus, and the construction method for board materials of the present invention, construction is simple and fast, and board materials can be stably supported.

DESCRIPTION OF EMBODIMENTS

Hereinafter, first to sixth embodiments specifying the present invention will be described with reference to the drawings. Note that in FIG. 1, a vertical upward direction is upward, and a vertical downward direction is downward. Also, in a direction from outside to inside the room in FIG. 1, a horizontal leftward direction is leftward, and a horizontal rightward direction is rightward. Also, the directions shown in FIG. 2 and onward correspond to those in FIG. 1.

First Embodiment

Figure 1:
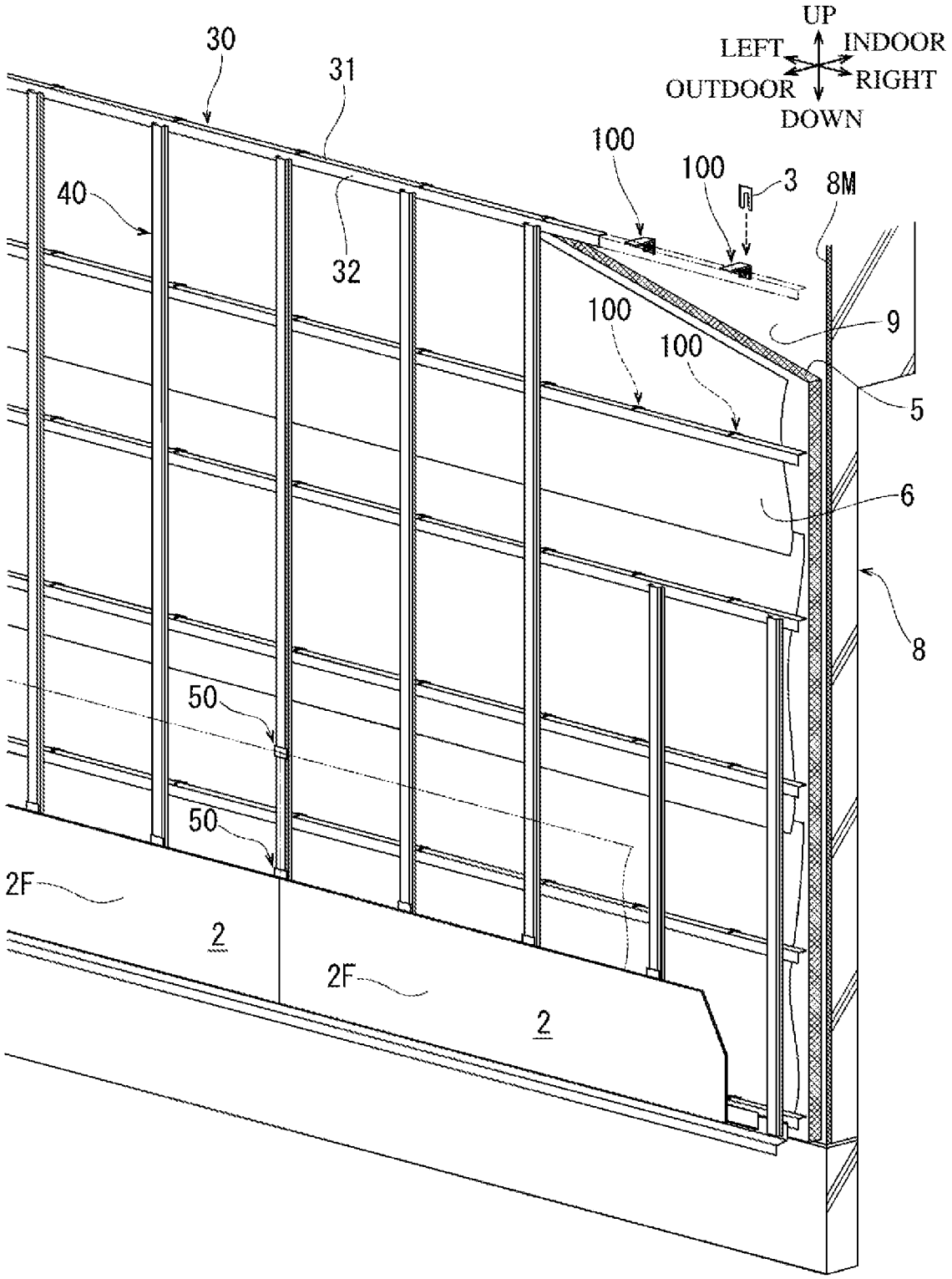
FIG. 1 is a perspective view of a wall structure for a building of a first embodiment.
Figure 2:
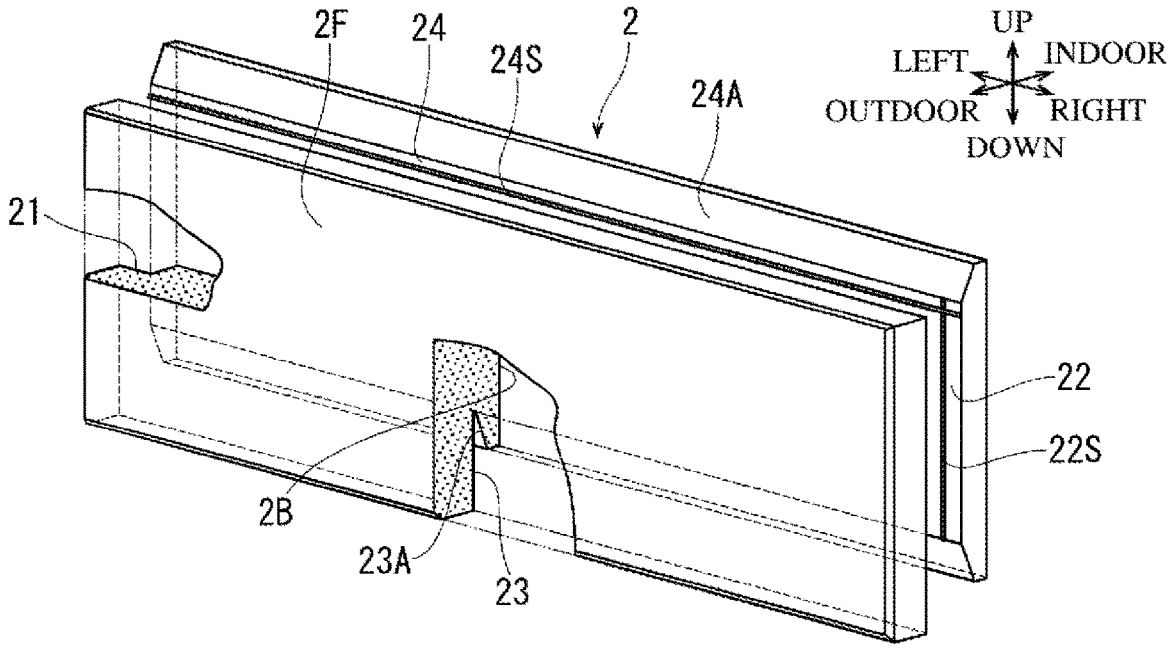
FIG. 2 is a perspective view of an outer wall board of the first embodiment.
Figure 3:
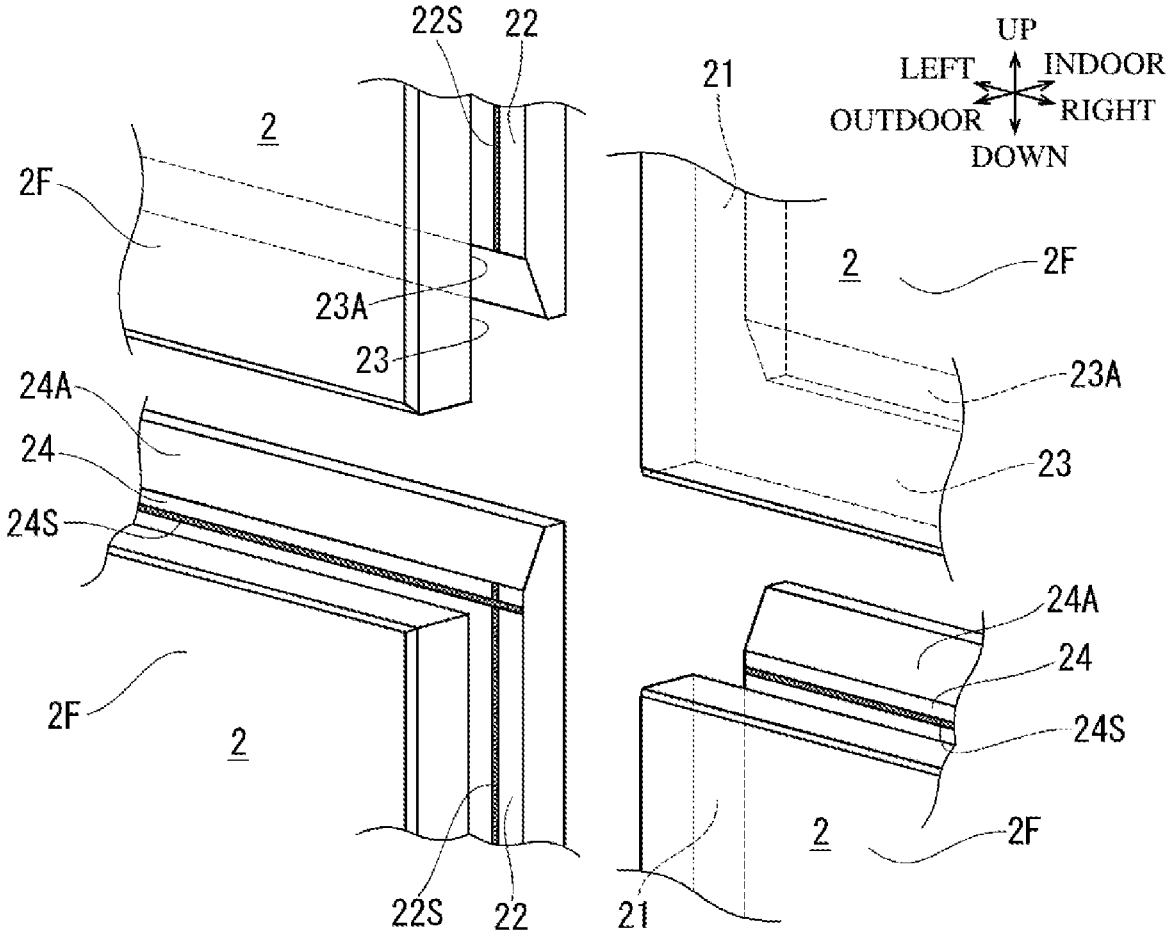
FIG. 3 is a partial perspective view according to the first embodiment.

As shown in FIG. 1, a wall structure of a first embodiment is an example of a specific form of a wall structure for a building. The wall structure is obtained by attaching multiple outer wall boards 2 to a structural body 8 included in a building such as a residence, a facility, or a warehouse. The structural body 8 may also be included in a newly-built building, or may be included in an already-built building to be subjected to construction work for reforming the building exterior. The outer wall boards 2 are an example of board materials. As shown in FIG. 2, FIG. 3, and the like, the outer wall boards 2 are board materials that have high strength and rigidity and that form an outer wall of a building. The outer wall boards 2 may also be used in a newly-built building, or may be for reforming for improving design by covering a wall surface of an already-built building. Note that the board material is not limited to an outer wall board, and for example, may also be a decorative board for covering the exterior of a building, a structure panel for indoor use, an interior board, or the like.

As shown in FIG. 1, the structural body 8 is a strong frame made of reinforced concrete or bricks, and mortar 8M is applied to the outermost layer on an outdoor side of the frame. The structural body 8 has a wall surface 9 that faces an outdoor direction. Note that the structural body is not limited to the present embodiment, and for example, the mortar 8M of the structural body 8 is omitted in some cases. Also, the structural body may also be included in a wooden building built using wood post and beam construction, timber frame construction, or the like.

Brackets 100, a heat insulating material 5, waterproof sheets 6, horizontal support bodies 30, vertical support bodies 40, and first attachment tools 50 are arranged between the structural body 8 and the outer wall boards 2. The horizontal support bodies 30 are an example of first support bodies. The vertical support bodies 40 are an example of second support bodies.

Figure 4:
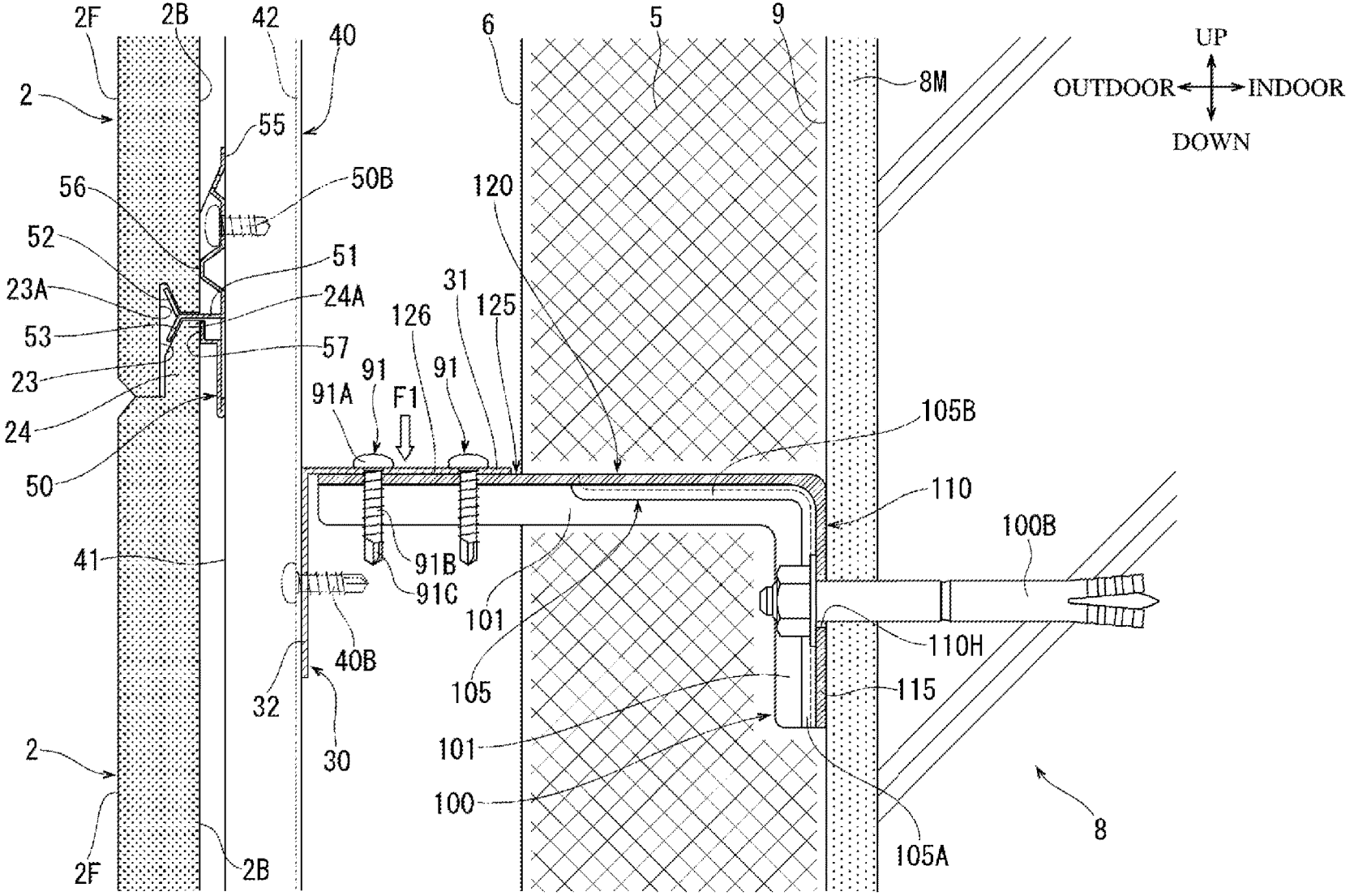
FIG. 4 is a partial cross-sectional view of the wall structure of the first embodiment.

As shown in FIGS. 1 and 4, multiple brackets 100 are arranged on the wall surface 9, separated from each other by predetermined intervals in the up-down direction and the left-right direction. The spacers 3 shown in FIG. 1 are arranged as needed between the brackets 100 and the wall surface 9. The spacers 3 are approximately rectangular boards with U-shaped grooves cut out. Due to the spacers 3 being made of resin, it is possible to block heat bridges between the brackets 100 and the wall surface 9. Also, by selecting the thickness and number of the spacers 3 according to the unevenness of the wall surface 9, the unevenness of the wall surface 9 can be adjusted to a certain extent.

Figure 5:
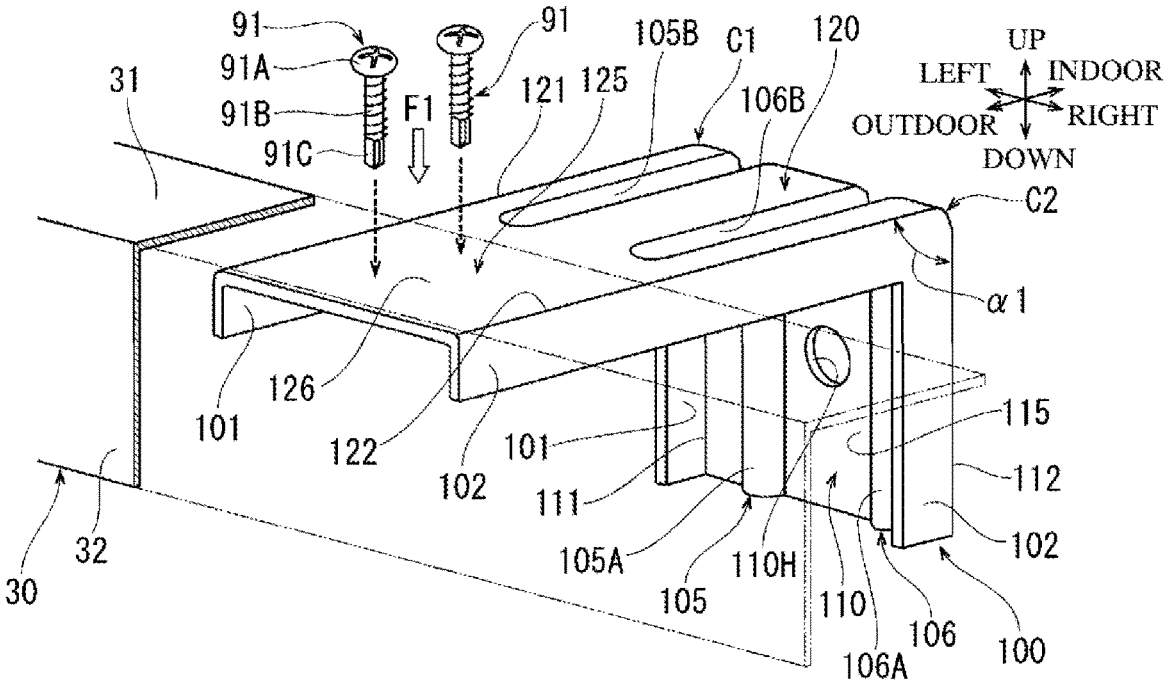
FIG. 5 is a perspective view according to the first embodiment.
Figure 6:
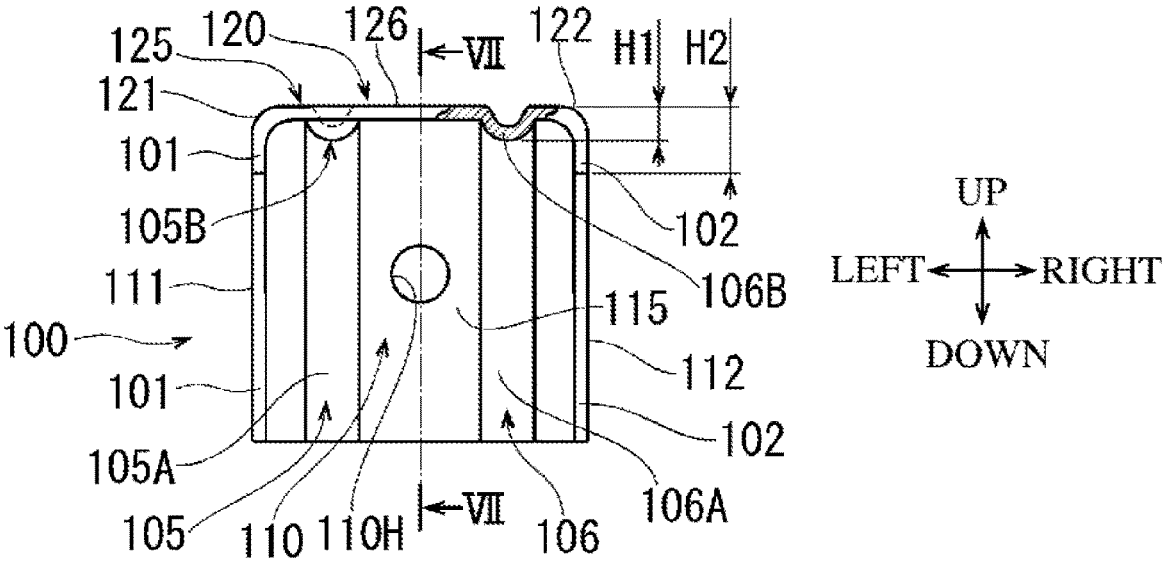
FIG. 6 is a front view of a bracket according to the first embodiment.
Figure 7:
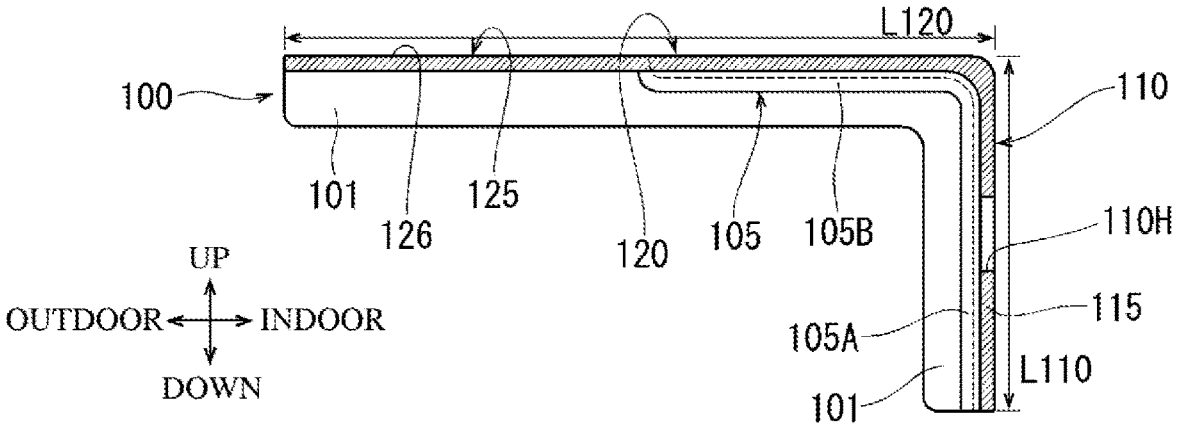
FIG. 7 is a cross-sectional view showing a cross-section taken along VII-VII in FIG. 6.

As shown in FIGS. 5 to 7, the bracket 100 is manufactured due to a metal board material being subjected to bending, pressing, and the like. To give an example, regarding the bracket 100, a steel board material with a thickness of about 2 mm is subjected to bending, pressing, and the like, and is formed into a three-dimensional shape without performing partial welding. Note that the material and manufacturing method of the bracket 100 is not limited to those described above, and various materials and manufacturing methods can be selected as appropriate. Also, during machining of the bracket 100, abutting end portions of two separately-bent protruding pieces are welded together, whereby the protruding pieces can be made continuous.

In the following description of the shape of the bracket 100, the up-down direction, the left-right direction, and the indoor-outdoor direction are defined with reference to the orientation of the brackets 100 in the state of being arranged on the wall surface 9, as shown in FIG. 4 and the like.

As shown in FIGS. 5 to 7, the bracket 100 includes a first portion 110, a second portion 120, a first side wall portion 101, a second side wall portion 102, protruding portions 105 and 106, and a mounting portion 125.

The first portion 110 is approximately square-shaped, and a circular hole 110H is provided through the approximate center thereof. The first portion 110 includes a fixing portion 115. The fixing portion 115 forms a flat surface that surrounds the circular hole 110H. As shown in FIG. 4, the fixing portion 115 is brought into contact with the wall surface 9 in a state of extending in the up-down direction and the left-right direction, an anchor bolt 100B is inserted through the circular hole 110H, and the anchor bolt 100B is further fastened to the side wall 9. Accordingly, the fixing portion 115 is fixed to the side wall 9.

As shown in FIG. 5, the second portion 120 is approximately rectangular and is connected to the upper edge of the first portion 110. The second portion 120 is bent from the first portion 110 in the outdoor direction and extends away from the fixing portion 115. The narrow angle of the angle formed by the first portion 110 and the second portion 120 is al. The narrow angle α1 is set to be an approximate right angle.

As shown in FIG. 7, a length L120 in the indoor-outdoor direction of the second portion 120 is set to be approximately twice a length L110 in the up-down direction of the first portion 110 for example, but there is no limitation to this configuration, and the length L120 may be greater or less than this length. For example, the length L120 can also be set to be equal to the length L110.

As shown in FIGS. 5 to 7, the first side wall portion 101 is approximately L-shaped due to connection between a board-shaped portion that is connected to the entire left side edge 111 of the first portion 110 and is bent at an approximate right angle in the outdoor direction, and a board-shaped portion that is connected to the entire left side edge 121 of the second portion 120 and is bent at an approximate right angle downward. That is, the first side wall portion 101 extends continuously from the lower end of the left side edge 111 of the first portion 110 to the leading end of the left side edge 121 of the second portion 120 and protrudes to the narrow angle α1 side.

The second side wall portion 102 is approximately L-shaped due to connection between a board-shaped portion that is connected to the entire right side edge 112 of the first portion 110 and is bent at an approximate right angle in the outdoor direction, and a board-shaped portion that is connected to the entire right side edge 122 of the second portion 120 and is bent at an approximate right angle downward. That is, the second side wall portion 102 extends continuously from the lower end of the right side edge 112 of the first portion 110 to the leading end of the right side edge 122 of the second portion 120 and protrudes to the narrow angle α1 side.

As shown in FIG. 5, a corner portion C1 formed by the first portion 110, the second portion 120, and the first side wall portion 101 is formed seamlessly through pressing. A corner portion C2 formed by the first portion 110, the second portion 120, and the second side wall portion 102 is also formed seamlessly through pressing.

As shown in FIGS. 5 to 7, in the first portion 110, a rib 105A that has a U-shaped cross-section is formed so as to protrude in the outdoor direction between the first side wall portion 101 and the circular hole 110H and extend in the up-down direction. In the second portion 120, a rib 105B that has a U-shaped cross-section and connects to the rib 105A is formed so as to protrude downward and extend in the indoor-outdoor direction. The protruding portion 105 on the left is formed by the ribs 105A and 105B.

In the first portion 110, a rib 106A that has a U-shaped cross-section is formed so as to protrude in the outdoor direction between the second side wall portion 102 and the circular hole 110H and extend in the up-down direction. In the second portion 120, a rib 106B that has a U-shaped cross-section and connects to the rib 106A is formed so as to protrude downward and extend in the indoor-outdoor direction. The protruding portion 106 on the right is formed by the ribs 106A and 106B.

The protruding portions 105 and 106 each extend upward from the lower edge of the first portion 110, are bent in the outdoor direction at the upper edge of the first portion 110, extend in the outdoor direction, and end at the approximate center of the second portion 120.

That is, the protruding portions 105 and 106 are provided between the first side wall portion 101 and the second side wall portion 102, extend continuously from the lower edge of the first portion 110 to the approximate center of the second portion 120, and protrude to the narrow angle α1 side.

The mounting portion 125 is provided on the leading edge side of the second portion 120. The mounting portion 125 includes a mounting surface 126. The mounting surface 126 is a flat surface that is surrounded by the leading edge of the second portion 120, the left-side edge 121, the right-side edge 122, and the leading ends of the protruding portions 105 and 106 and faces the side opposite to the first side wall portion 101 and the second side wall portion 102. That is, the mounting surface 126 is an upward-facing flat surface formed in a range of the second portion 120 that is farther from the first portion 110 than the leading ends of the protruding portions 105 and 106.

As shown in FIG. 6, a first height H1 to which the protruding portions 105 and 106 protrude downward with respect to the mounting surface 126 is set to be less than or equal to a second height H2 to which the first side wall portion 101 and the second side wall portion 102 protrude downward with respect to the mounting surface 126.

As shown in FIGS. 1 and 4, the heat insulating material 5 is arranged along the wall surface 9 of the structural body 8. The heat insulating material 5 is, for example, a fibrous heat insulating material such as rock wool or glass wool, a plastic foam-type heat insulating material such as polyurethane foam, phenol foam, or polystyrene foam, or the like. The heat insulating material 5 is arranged such that portions that interfere with the brackets 100 are removed and the leading edge sides of the mounting portions 125 of the brackets 100 are exposed. Note that the heat insulating material 5 can also be omitted, depending on the construction state or the like of the structural body 8.

The waterproof sheets 6 are laid on the front surface of the heat insulating material 5. The waterproof sheets 6 are composed of waterproof paper, film, nonwoven fabric, or the like, and some are moisture-permeable instead of being waterproof. Note that the waterproof sheets 6 can also be omitted, depending on the construction state or the like of the structural body 8. Notches are formed in the waterproof sheets 6 at locations corresponding to the second portions 120 of the brackets 100, and the waterproof sheets 6 are arranged so as to cause the leading edge sides of the mounting portions 125 of the brackets 100 to protrude.

As shown in FIGS. 4 and 5, the horizontal support body 30 is an elongated board material having an L-shaped cross-section. The horizontal support body 30 includes a first joining portion 31 and a second joining portion 32. The second joining portion 32 connects to one edge of the flat board-shaped first joining portion 31, and extends in a flat board shape in a direction approximately orthogonal to the first joining portion 31. The horizontal support body 30 is manufactured by performing bending and the like on a steel board material, for example. Note that the material and manufacturing method of the horizontal support body 30 are not limited to those described above, and various types of materials including resin, wood, and the like, and manufacturing methods can be selected as appropriate.

As shown in FIG. 1, the multiple horizontal support bodies 30 are arranged on the wall surface 9 in a state of being separated from each other at a predetermined interval in the up-down direction on the outdoor side with respect to the waterproof sheets 6, and extending in the left-right direction along the wall surface 9. A horizontal support body 30 is arranged extending across at least two brackets 100. As shown in FIGS. 4 and 5, the bracket 100 and the horizontal support body 30 are fastened to each other by first drill screws 91. The left-right direction is an example of a first direction. The first drill screws 91 are an example of fastening members.

More specifically, the horizontal support bodies 30 are put in a state in which the first joining portions 31 are mounted on the mounting surfaces 126 of the brackets 100 and the second joining portions 32 are located on the side opposite to the wall surface 9 with respect to the first joining portions 31.

A known drill screw, in which a drill such as a cutting blade portion or a tapered portion is formed at the leading end of a screw, and which performs pilot hole drilling, tapping, and fastening with the screw itself, is used as the first drill screw 91. Specifically, the first drill screw 91 includes a screw portion 91B, a cutting blade portion 91C formed on the leading end of the screw portion 91B, and a head portion 91A that connects to the base of the screw portion 91B.

First, unevenness in the wall surface 9 is adjusted by shifting the position of the first joining portion 31 of the horizontal support body 30 mounted on the mounting surface 126 in the indoor-outdoor direction according to the protrusion and recession of the wall surface 9 of the structural body 8. Then, the first drill screw 91 is held in an electric screwdriver (not shown) by fitting the leading end portion of the electric screwdriver (not shown) into a groove provided in the head portion 91A of the first drill screw 91. Next, the cutting blade portion 91C of the first drill screw 91 is brought into contact with the first joining portion 31 from above, and the fastening position is determined. Then, the electric screwdriver (not shown) is operated while causing a downward load F1 to act on the first drill screw 91. Upon doing so, the cutting blade portion 91C rotates while being pressed into the first joining portion 31 and the mounting portion 125, and thereby cuts the first joining portion 31 and the mounting portion 125 while discharging cutting debris and drills pilot holes in the first joining portion 31 and the mounting portion 125. The screw portion 91B performs tapping using a portion adjacent to the cutting blade portion 91C and performs fastening on the first joining portion 31 and the mounting portion 125 using a portion located on the head portion 91A side with respect to the portion adjacent to the cutting blade portion 91C. The downward load F1 reaches its maximum when the cutting blade portion 91C opens a pilot hole in the first joining portion 31 and the mounting portion 125.

In this manner, the first drill screw 91 penetrates through the mounting portion 125 and the first joining portion 31 in the up-down direction, which is perpendicular to the mounting surface 126, and fastens the mounting portion 125 and the first joining portion 31 to each other. Note that the present invention also encompasses a configuration in which a pilot hole is drilled in advance at a position corresponding to the fastening location of the first joining portion 31.

Figure 8:
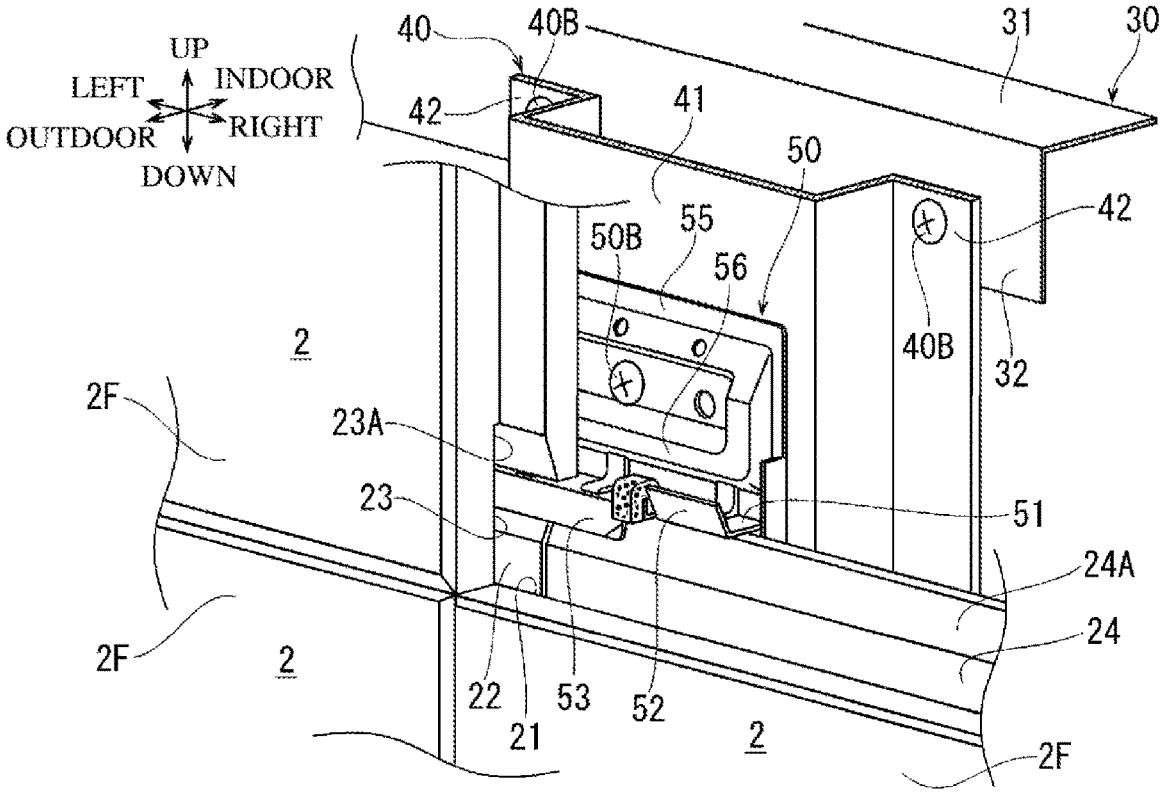
FIG. 8 is a partial perspective view according to the first embodiment.

As shown in FIGS. 4 and 8, the vertical support body 40 is an elongated board material having a hat-shaped cross-section. The vertical support body 40 includes a central board portion 41 and a pair of side board portions 42. The pair of side board portions 42 are connected with a level difference to both side edges of the flat board-shaped central board portion, and extend in flat board shapes in the direction away from each other. The vertical support body 40 is manufactured by performing bending and the like on a steel board material, for example. Note that the material and manufacturing method of the vertical support body 40 are not limited to those described above, and various types of materials including resin, wood, and the like, and manufacturing methods can be selected as appropriate.

As shown in FIG. 1, the multiple vertical support bodies 40 are arranged on the wall surface 9 in a state of being separated from each other by a predetermined interval in the left-right direction on the outdoor side with respect to the second joining portions 32 of the horizontal support bodies 30, and extending in the up-down direction along the wall surface 9. The vertical support bodies 40 are each arranged extending across at least two horizontal support bodies 30. Also, as shown in FIGS. 4 and 8, the pair of side board portions 42 of the vertical support body 40 and the second joining portion 32 of the horizontal support body 30 are fastened to each other by the screw 40B. The up-down direction is an example of a second direction.

The screws 40B shown in FIG. 4 are also drill screws. If drill screws are not used, a task of drilling pilot holes in the side board portion 42 and the second joining portion 32 is needed before the task of fastening the pair of side board portions 42 of the vertical support body 40 and the second joining portion 32 of the horizontal support body 30 to each other using the screws 40B.

Figure 9:
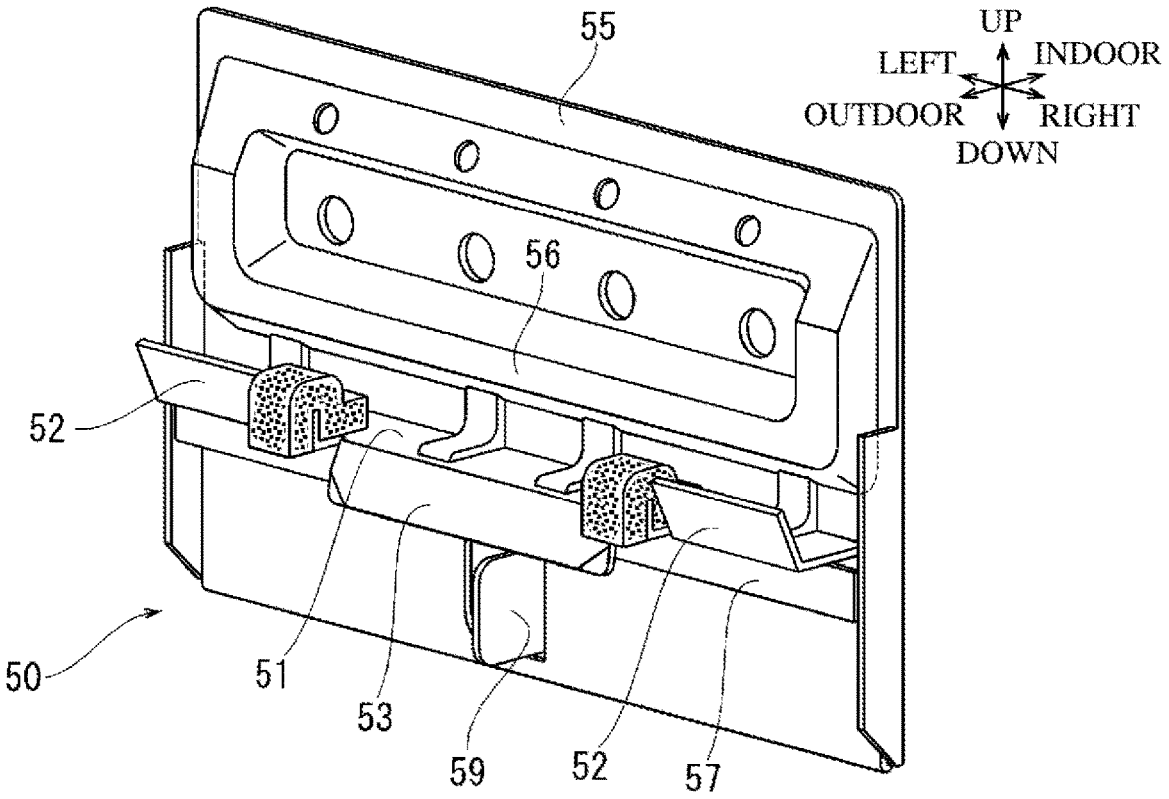
FIG. 9 is a perspective view of a first attachment tool according to the first embodiment.

As shown in FIG. 9, the first attachment tool 50 includes a first fixing portion 55, a first upper contact portion 56, a first lower contact portion 57, a first bearing portion 51, first upper locking portions 52, a first lower locking portion 53, and a standing piece 59. The first fixing portion 55 forms a flat surface that can come into contact with the central board portion 41 of the vertical support body 40. The first upper contact portion 56 bulges in the outdoor direction away from the first fixing portion 55. The first lower contact portion 57 bulges in the outdoor direction away from the first fixing portion 55 at a position below the first upper contact portion 56. The first bearing portion 51 protrudes in the outdoor direction from the first fixing portion 55 between the first upper contact portion 56 and the first lower contact portion 57 and extends in the left-right direction. The first upper locking portion 52 protrudes upward from the leading end portion of the first bearing portion 51. The first lower locking portion 53 protrudes downward from the leading end portion of the first bearing portion 51. The standing piece 59 protrudes in the outdoor direction from the first fixing portion 55 below the first lower contact portion 57 and extends in the up-down direction.

As shown in FIGS. 1 and 4, the multiple first attachment tools 50 are arranged on the wall surface 9 in a state of being separated from each other at predetermined intervals in the up-down direction and the left-right direction on the outdoor side with respect to the central board portions 41 of the vertical support bodies 40. As shown in FIG. 8, the first attachment tool 50 is put in a state in which the first fixing portion 55 is in contact with the central board portion 41 of the vertical support body 40 at a position corresponding to four mutually-abutting corners of multiple outer wall boards 2. Also, the first fixing portion 55 of the first attachment tool 50 and the central board portion 41 of the vertical support body 40 are fastened to each other using a screw 50B. Note that attachment tools with a configuration in which the standing piece 59 has been removed from the first attachment tool 50 are arranged between the first attachment tools 50 as needed.

As shown in FIG. 2, the outer wall board 2 is a board material with a quadrilateral shape, or more specifically, an approximately rectangular shape that is elongated in the left-right direction. In the present embodiment, the outer wall board 2 is composed of a ceramic material including cement. Note that the material and shape of the outer wall board 2 are not limited to those described above. For example, as the material of the outer wall board 2, a metal material, a wood material, a resin material, or the like can be selected as appropriate. Also, as the shape of the outer wall board 2, a board material that has a quadrilateral shape that is an approximately rectangular shape elongated in the up-down direction, or the like can be selected as appropriate.

A surface 2F of the outer wall board 2 is an exterior surface on which a design such as a brick pattern has been implemented, for example. A front-side left-right joining portion 21 is formed on the left end portion of the outer wall board 2. A back-side left-right joining portion 22 is formed on the right end portion of the outer wall board 2. A front-side up-down joining portion 23 is formed on the lower end portion of the outer wall board 2. A back-side up-down joining portion 24 is formed on the upper end portion of the outer wall board 2.

The front-side up-down joining portion 23 is an example of a first shiplap joining portion of a board material. The back-side up-down joining portion 24 is an example of a second shiplap joining portion of a board material. The back-side left-right joining portion 22 is an example of a third shiplap joining portion of a board material. The front-side left-right joining portion 21 is an example of a fourth shiplap joining portion of a board material. Note that in FIG. 2, the sizes of the front-side left-right joining portion 21, the back-side left-right joining portion 22, the back-side up-down joining portion 23, and the front-side up-down joining portion 24 are shown exaggerated compared to the size of the outer wall board 2.

As shown in FIGS. 2 and 3, the front-side left-right joining portion 21 is recessed toward the front surface 2F from the back surface 2B of the outer wall board 2, and extends in the vertical direction, that is, along the left end portion of the outer wall board 2.

The back-side left-right joining portion 22 is recessed toward the under surface 2B from the outer surface 2F of the outer wall board 2, and extends in the vertical direction, that is, along the right end portion of the outer wall board 2. Corking 22S is provided on the flat surface of the back-side left-right joining portion 22 facing the outdoor direction. The corking 22S is provided in a linear shape along the back-side left-right joining portion 22. Note that the corking is not essential, and the corking 22S can also be omitted.

The front-side up-down joining portion 23 is recessed toward the front surface 2F from the back surface 2B of the outer wall board 2 and extends in the left-right direction, that is, along the lower end portion of the outer wall board 2. An engagement recessed portion 23A that is recessed upward in an approximately tapered shape is formed on the front-side up-down joining portion 23.

The back-side up-down joining portion 24 is recessed toward the back surface 2B from the front surface 2F of the outer wall board 2 and extends in the left-right direction, that is, along the upper end portion of the outer wall board 2. Corking 24S is provided on the flat surface of the back-side up-down joining portion 24 facing the outdoor direction. The corking 24S is provided in a linear shape along the back-side up-down joining portion 24. Note that the corking is not essential, and the corking 24S can also be omitted. An engagement protruding portion 24A that protrudes upward in an approximately tapered shape is formed above the corking 24S in the back-side up-down joining portion 24.

As shown in FIGS. 4 and 8, due to the back-side up-down joining portion 24 of the lower-side outer wall board 2 and the front-side up-down joining portion 23 of the upper-side outer wall board 2 overlapping, an up-down shiplap portion (joining portion in the vertical direction) that extends in the left-right direction is formed between the outer wall boards 2 that are adjacent in the up-down direction. As shown in FIG. 8, due to the front-side left-right joining portion 21 of the right-side outer wall board 2 and the back-side left-right joining portion 22 of the left-side outer wall board 2 overlapping, a left-right shiplap portion that extends in the up-down direction (joining portion in the horizontal direction) is formed between the outer wall boards 2 that are adjacent in the left-right direction. That is, the outer wall board 2 is a board material that has a so-called "four-way shiplap structure", which includes the front-side left-right joining portion 21, the back-side left-right joining portion 22, the front-side up-down joining portion 23, and the back-side up-down joining portion 24.

As shown in FIGS. 1, 4, and 8, the multiple outer wall boards 2 are attached by the attachment tools 50 to the side of at least two vertical support bodies 40 that is opposite to the wall surface 9, that is, to the central board portions 41, and cover the wall surface 9 in a state of being adjacent in the up-down direction and the left-right direction. The outer wall boards 2 are attached indirectly to the side of at least two horizontal support bodies 30 that is opposite to the wall surface 9, and are arranged indirectly on the second joining portions 32 of the horizontal support bodies 30.

Here, the first lower locking portion 53 of the first attachment tool 50 locks the engagement protruding portion 24A of the lower-side outer wall board 2. Also, the first upper locking portion 52 locks the engagement recessed portion 23A of the upper-side outer wall board 2. The first bearing portion 51 bears the lower end portion of the upper-side outer wall board 2. The first upper contact portion 56 and the first lower contact portion 57 come into contact with the back surfaces 2B of the upper and lower outer wall boards 2 and ensure an airflow space between the wall surface 9 of the structural body 8 and the back surfaces 2B of the outer wall boards 2. The standing piece 59 prevents horizontal shifting of the outer wall boards 2 by being arranged between the mutually opposing side end surfaces of the outer wall boards 2 that are adjacent in the left-right direction, although this is not shown in the drawings. In this manner, the first attachment tool 50 supports the outer wall boards 2 at the mutually-abutting corner portions of the multiple outer wall boards 2. Note that another attachment tool without the standing piece 59 supports the up-down shiplap portion of the outer wall boards 2 that are adjacent in the up-down direction between the first attachment tools 50.

By implementing this kind of task on the other outer wall boards 2 as well, the outer wall boards 2 are supported by the structural body 8 and cover the wall surface 9 in a state of being adjacent in the up-down direction and the left-right direction.

Effects

To summarize the above-described construction method for the outer wall boards 2, the construction method for the outer wall boards 2 of the first embodiment is implemented through first to fourth steps.

As shown in FIGS. 1 and 4, in the first step, multiple brackets 100 are arranged on the wall surface 9 by fixing the fixing portions 115 to the structural body 8 using anchor bolts 100B.

In the second step, the multiple horizontal support bodies 30 are put in a state of extending in the left-right direction along the wall surface 9 and being arranged extending across at least two brackets 100. At this time, the first joining portions 31 of the horizontal support bodies 30 are mounted on the mounting surfaces 126 of the brackets 100.

In the third step, the brackets 100 and the horizontal support bodies 30 are fastened to each other using the first drill screws 91. Specifically, as shown in FIG. 5, the electric screwdriver (not shown) is operated while pressing the first drill screw 91 held in the electric screwdriver into the first joining portion 31 and the mounting portion 125, and applying the load F1.

Then, as shown in FIG. 4, the first drill screw 91 penetrates through the mounting portion 125 and the first joining portion 31 in the up-down direction, which is perpendicular to the mounting surface 126 and fastens the mounting portion 125 and the first joining portion 31 to each other.

The fourth step includes a fifth step and a sixth step. As shown in FIGS. 1 and 4, in the fifth step, the multiple vertical support bodies 40 are put in a state of extending in the up-down direction, which intersects the horizontal support bodies 30 along the wall surface 9, and being arranged extending across at least two horizontal support bodies 30. Then, the vertical support bodies 40 are arranged at the second joining portions 32 of the horizontal support bodies 30 due to the pairs of side board portions 42 of the vertical support bodies 40 and the second joining portions 32 of the horizontal support bodies 30 being fastened to each other using the screws 40B.

In the sixth step, the multiple outer wall boards 2 are attached to the side of at least two vertical support bodies 40 that is opposite to the wall surface 9 using the first attachment tools 50 fastened to the central board portions 41 of the vertical support bodies 40, and cover the wall surface 9.

In the present embodiment, in the third step, by using brackets 100 having the first and second side wall portions 101 and 102 that extend continuously from the first portion 110 to the second portion 120, unevenness in the wall surface 9 can be adjusted when placing the first joining portions 31 of the horizontal support bodies 30 on the mounting surfaces 126, and the brackets 100 and the horizontal support bodies 30 can be fastened to each other using the first drill screws 91 at that position.

That is, as shown in FIG. 5, even if a significant load F1 is applied to the bracket 100 when the first drill screw 91 fastens the mounting portion 125 and the first joining portion 31 to each other, the bracket 100, which is reinforced by the first and second side wall portions 101 and 102, can withstand the load F1. For this reason, the unevenness adjustment of the wall surface 9 and the arrangement of the horizontal support bodies 30 can be implemented in the same step, and therefore construction is simpler and faster.

Also, due to the fact that the configuration in which the first drill screws 91 fasten the mounting portions 125 and the first joining portions 31 to each other does not use an elongated hole or the like, looseness and gaps are less likely to occur between the brackets 100 and the horizontal support bodies 30. Furthermore, deformation caused by the brackets 100 supporting the weight of the outer wall portions 2 over a long period can be suppressed by the first and second side wall portions 101 and 102.

Accordingly, with the wall structure for a building and the construction method for the outer wall boards 2 of the first embodiment, construction is simple and fast, and the outer wall boards 2 can be stably supported.

Also, the first portion 110 and second portion 120 of the bracket 100 and the connection portion of the first portion 110 and the second portion 120 can be reinforced by the protruding portions 105 and 106 shown in FIGS. 5 to 7. Also, as shown in FIG. 4, the heat insulating material 5 is arranged around the bracket 100, but the heights of the first and second side wall portions 101 and 102 can be kept small due to the protruding portions 105 and 106 taking on the role of increasing the rigidity. For this reason, on the sides of the brackets 100 on which the first and second side wall portions 101 and 102 are formed, it is possible to suppress the occurrence of gaps between the heat insulating material 5 and the brackets 100 using the first and second side wall portions 101 and 102.

Furthermore, as shown in FIG. 6, the first height H1 to which the protruding portions 105 and 106 protrude with respect to the mounting surface 126 is set to be less than or equal to the second height H2 to which the first side wall portion 101 and the second side wall portion 102 protrude with respect to the mounting surface 126. Accordingly, the second height H2 can be reduced according to the reinforcing effect of the bracket 100 by the protruding portions 105 and 106, and it is possible to suppress a case in which the first and second side wall portions 101 and 102 and the protruding portions 105 and 106 impede construction. Also, when the heat insulating material 5 is arranged around the bracket 100, it is possible to effectively suppress the occurrence of gaps between the heat insulating material 5 and the bracket 100 near the first and second side wall portions 101 and 102.

Also, the protruding portions 105 and 106 protrude only to the approximate center in the longitudinal direction of the second portion 120. For this reason, the mounting surface 126 is flat in the range of the second portion 120 in which the protruding portions 105 and 106 are not present. Accordingly, the first joining portion 31 of the horizontal support body 30 can be reliably mounted on the mounting surface 126, and the mounting portion 125 and the first joining portion 31 can be reliably fastened to each other by the first drill screws 91.

Furthermore, the outer wall board 2 has a so-called "four-way shiplap structure", an up-down shiplap portion is formed by the front-side up-down joining portion 23 and the back-side up-down joining portion 24 overlapping, and a left-right shiplap portion is formed by the front-side left-right joining portion 21 and the back-side left-right joining portion 22 overlapping. Accordingly, gaps between the outer wall boards 2 that are adjacent in the up-down direction and the left-right direction are not likely to occur. For this reason, the joining and waterproof property of the outer wall boards 2 can be ensured without using sealing or the like. Moreover, the quality of the appearance of the joining portions of the outer wall boards 2 also improves. Accordingly, it is possible to provide a high-quality wall structure for which construction is simple.

Second Embodiment

Figure 10:
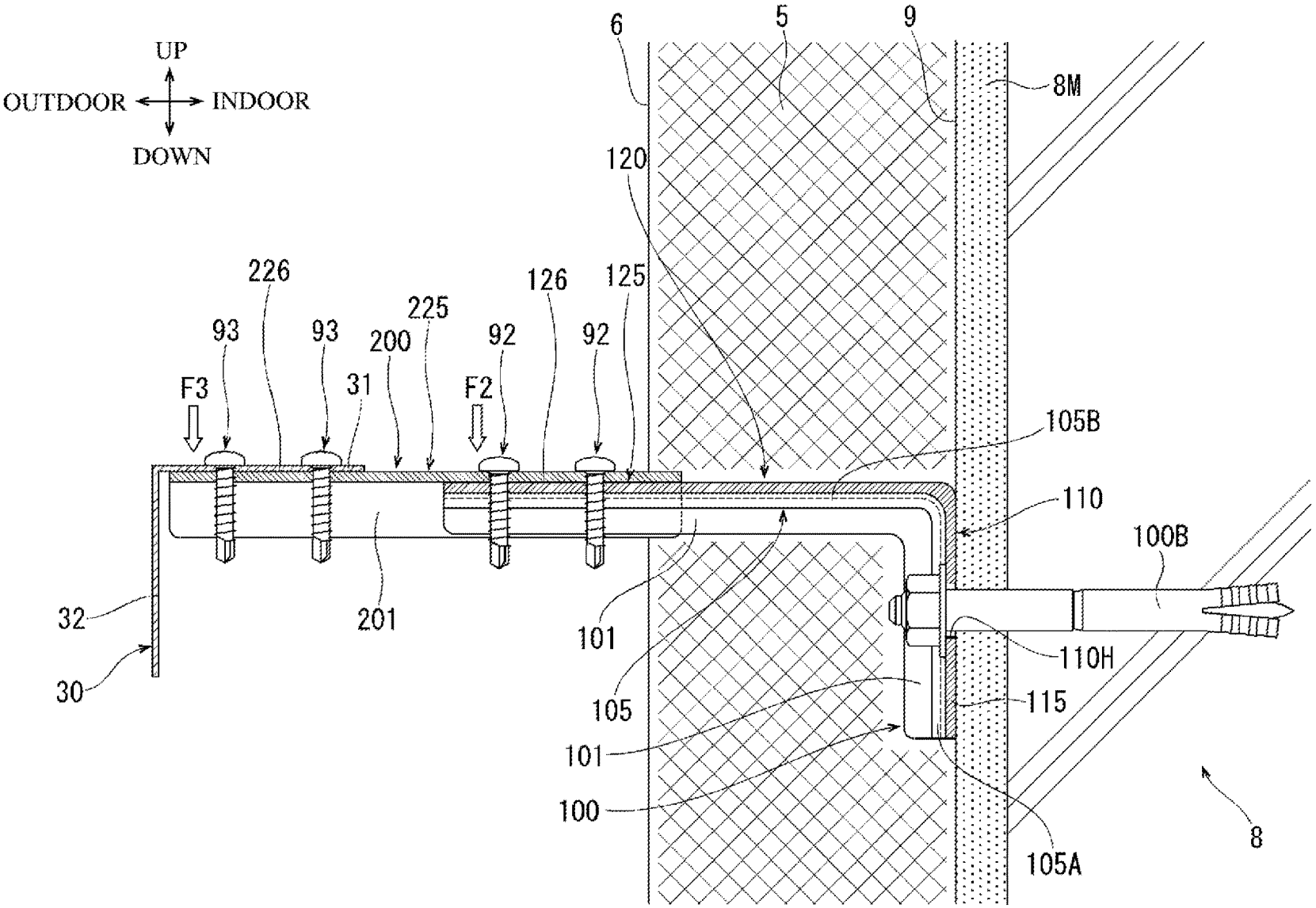
FIG. 10 is a partial cross-sectional view of a wall structure of a second embodiment.
Figure 11:
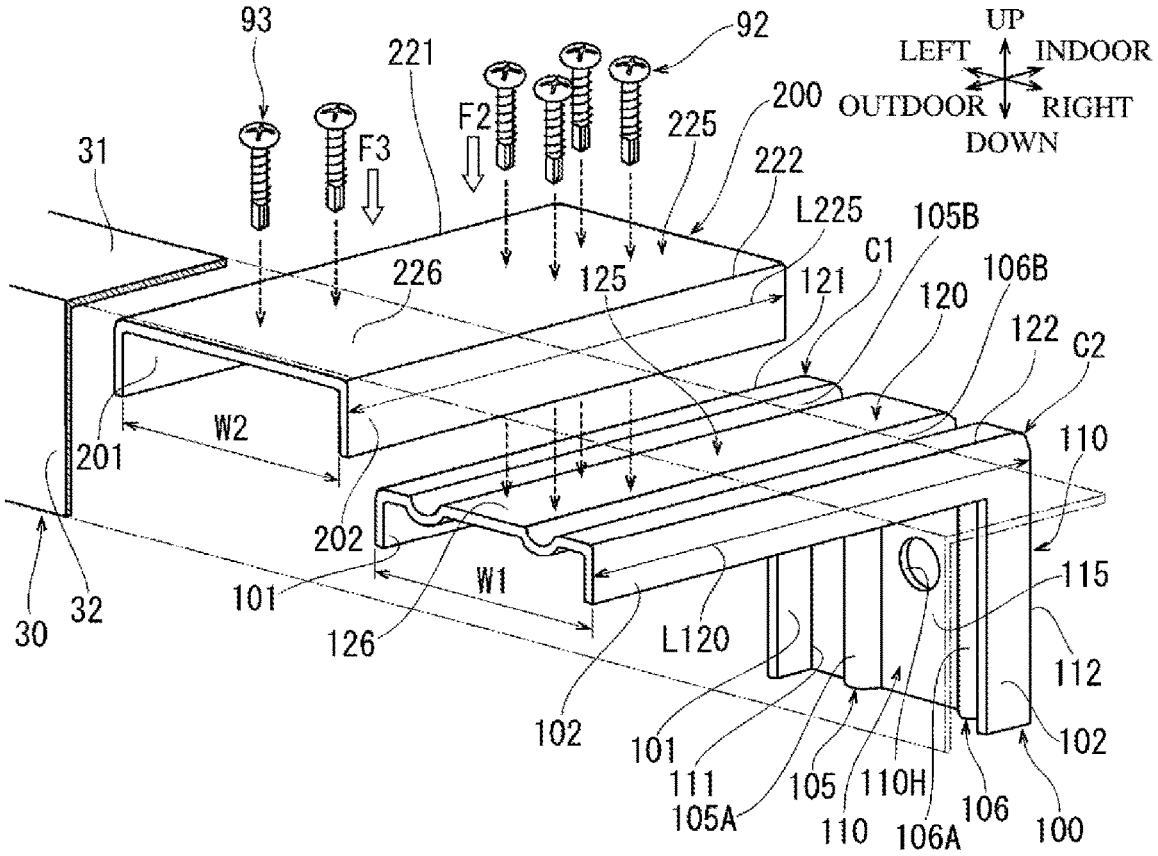
FIG. 11 is a perspective view according to the second embodiment.
Figure 12:
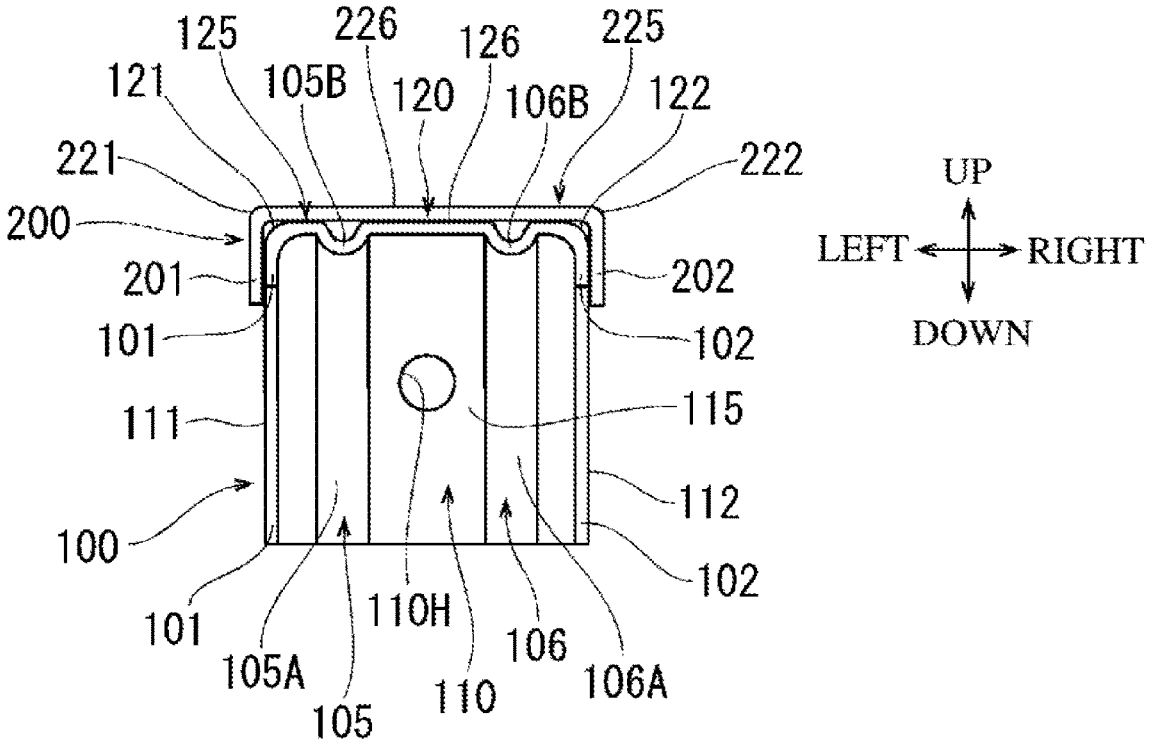
FIG. 12 is a front view according to the second embodiment.

As shown in FIGS. 10 to 12, with a wall structure of a second embodiment, a case is indicated in which in the third step of the first embodiment, the unevenness of the wall surface 9 is so significant that the unevenness of the wall surface 9 cannot be adjusted with the positioning of the first joining portion 31 of the horizontal support body 30 with respect to the mounting surface 126 of the bracket 100. In this case, an extension member 200 is arranged between the mounting portion 125 of the bracket 100 and the first joining portion 31 of the horizontal support body 30, whereby the significant unevenness is adjusted. Also, with the wall structure of the second embodiment, regarding the bracket 100, the protruding portions 105 and 106 are extended until reaching the leading edge of the second portion 120. Accordingly, the mounting surface 126 is a flat surface divided into multiple surfaces in the width direction by the protruding portions 105 and 106. Other configurations of the second embodiment are the same as those of the first embodiment. For this reason, configurations identical to those of the first embodiment will be denoted by reference numerals identical thereto, and description thereof will be omitted or simplified.

The extension member 200 is manufactured due to a metal board material being subjected to bending or the like. To give an example, the extension member 200 is formed into an approximate C shape in cross section due to a steel board material with a thickness of about 2 mm being subjected to bending or the like. Note that the material and manufacturing method of the extension member 200 is not limited to those described above, and various materials and manufacturing methods can be selected as appropriate.

In the following description of the shape of the extension member 200, as shown in FIG. 10, the orientation of the extension member 200 in the state of being arranged between the mounting portion 125 of the bracket 100 and the first joining portion 31 of the horizontal support body 30 will be used as a reference.

The extension member 200 includes an extension mounting portion 225, a first extension side wall portion 201, and a second extension side wall portion 202.

As shown in FIG. 11, the extension mounting portion 225 has an approximate rectangular shape. In one example, a length L225 in the indoor-outdoor direction of the extension mounting portion 225 is set to be approximately equal to the length L120 in the indoor-outdoor direction of the second portion 120, but the length L225 may also be longer or shorter than the length L120. The extension mounting portion 225 includes an extension mounting surface 226. The extension mounting surface 226 is the upper surface of the extension mounting portion 225.

The first extension side wall portion 201 is formed continuously from one end to another end of the left side edge 221 of the extension mounting portion 225. The first extension side wall portion 201 protrudes downward from the left side edge 221 and extends in the indoor-outdoor direction.

The second extension side wall portion 202 is formed similarly to the first extension side wall portion 201 on the right side edge 222 of the extension mounting portion 225.

An inner width W2 of the first extension side wall portion 201 and the second extension side wall portion 202 of the extension member 200 is set to be slightly longer than an outer width W1 of the first side wall portion 101 and the second side wall portion 102 of the bracket 100.

As follows, the extension member 200 is arranged between the mounting portion 125 of the bracket 100 and the first joining portion 31 of the horizontal support body 30, the extension mounting portion 225 and the mounting portion 125 are fastened to each other by second drill screws 92, and the extension mounting portion 225 and the first joining portion 31 are fastened to each other by third drill screws 93. The second drill screw 92 and the third drill screw 93 are examples of fastening means. The configurations of the second drill screw 92 and the third drill screw 93 are the same as that of the first drill screw 91, and therefore description thereof is simplified.

The task of arranging the extension member 200 between the mounting portion 125 and the first joining portion 31 is included in the above-described second step. The task of fastening the extension mounting portion 225 and the mounting portion 125 using the second drill screws 92 and the task of fastening the extension mounting portion 225 and the first joining portion 31 using the third drill screws 93 are included in the above-described third step.

The extension member 200 is put in a state in which the extension mounting portion 225 is mounted on the mounting surface 126 of the bracket 100 and extends in the outdoor direction away from the first portion 110 of the bracket 100, and the extension mounting surface 226 faces the same side as the mounting surface 126. Accordingly, the first extension side wall portion 201 protrudes downward similarly to the first side wall portion 101 and is adjacent to the first side wall portion 101. Also, the second extension side wall portion 202 protrudes downward similarly to the second side wall portion 102 and is adjacent to the second side wall portion 102. At this time, unevenness in the wall surface 9 can be adjusted by shifting the position of the extension mounting portion 225 mounted on the mounting surface 126 in the indoor-outdoor direction.

Also, a task similar to the fastening task performed using the first drill screws 91 is performed using the second drill screws 92. Accordingly, the second drill screws 92 perform pilot hole drilling, tapping, and fastening on the extension mounting portion 225 and the mounting portion 125.

In this manner, the second drill screw 92 penetrates through the mounting portion 125 and the extension mounting portion 225 in the up-down direction perpendicular to the mounting surface 126, and fastens the mounting portion 125 and the extension mounting portion 225. Note that a configuration in which a pilot hole is drilled in advance at a location corresponding to the fastening location of the extension mounting portion 225 is also included in the present invention.

Next, the horizontal support body 30 is put in a state in which the first joining portion 31 is mounted on the extension mounting surface 226 of the extension member 200 and the second joining portion 32 is connected to the first joining portion 31 on a side opposite to the wall surface 9. At this time, the unevenness in the wall surface 9 can be adjusted also by shifting the position of the first joining portion 31 of the horizontal support body 30 mounted on the extension mounting surface 226 in the indoor-outdoor direction according to the protrusion or recession of the wall surface 9.

Also, a task similar to the fastening task performed using the first drill screws 91 is performed using the third drill screws 93. Accordingly, the third drill screws 93 perform pilot hole drilling, tapping, and fastening on the extension mounting portion 225 and the first joining portion 31.

In this manner, the third drill screws 93 penetrate through the extension mounting portion 225 and the first joining portion 31 in the up-down direction perpendicular to the extension mounting surface 226 and fasten the extension mounting portion 225 and the first joining portion 31 to each other. Note that the present invention also encompasses a configuration in which pilot holes are drilled in advance at positions corresponding to the fastening locations of the first joining portion 31.

Thus, even if the unevenness in the wall surface 9 is significant in the wall structure and the construction method for the outer wall boards 2 of the second embodiment, the bracket 100 and the horizontal support body 30 can be fastened to each other after the unevenness is adjusted using the extension member 200. Accordingly, it is possible to reliably realize a case in which the horizontal support body 30 is arranged straight in the left-right direction, and as a result, the outer wall boards 2 can be provided on the structural body 8 with high accuracy.

Accordingly, with the wall structure and the construction method for the outer wall boards 2 of the second embodiment as well, construction is simple and fast, and the outer wall boards 2 can be stably supported.

Also, as shown in FIG. 12, due to the first and second extension side wall portions 201 and 202 sandwiching the first and second side wall portions 101 and 102, horizontal shifting of the extension member 200 with respect to the mounting portion 125 can be suppressed when the extension member 200 slides in the direction of moving toward or away from the wall surface 9 and when the second drill screws 92 fasten the mounting portion 125 and the extension mounting portion 225 to each other.

Furthermore, as shown in FIG. 11, even if a significant load F2 is applied to the extension member 200 when the second drill screws 92 fasten the mounting portion 125 and the extension mounting portion 225 to each other, the extension member 200, which is reinforced by the first and second extension side wall portions 201 and 202, can withstand the load F2. Also, even if a significant load F3 is applied to the extension member 200 when the third drill screws 93 fasten the extension mounting portion 225 and the first joining portion 31 to each other, the extension member 200 reinforced by the first and second extension side wall portions 201 and 202 can withstand the load F3. As a result, the unevenness in the wall surface 9 can be adjusted and the horizontal support body 30 can be fastened simply and strongly to the bracket 100 using the extension member 200 and the second and third drill screws 92 and 93.

Third Embodiment

Figure 13:
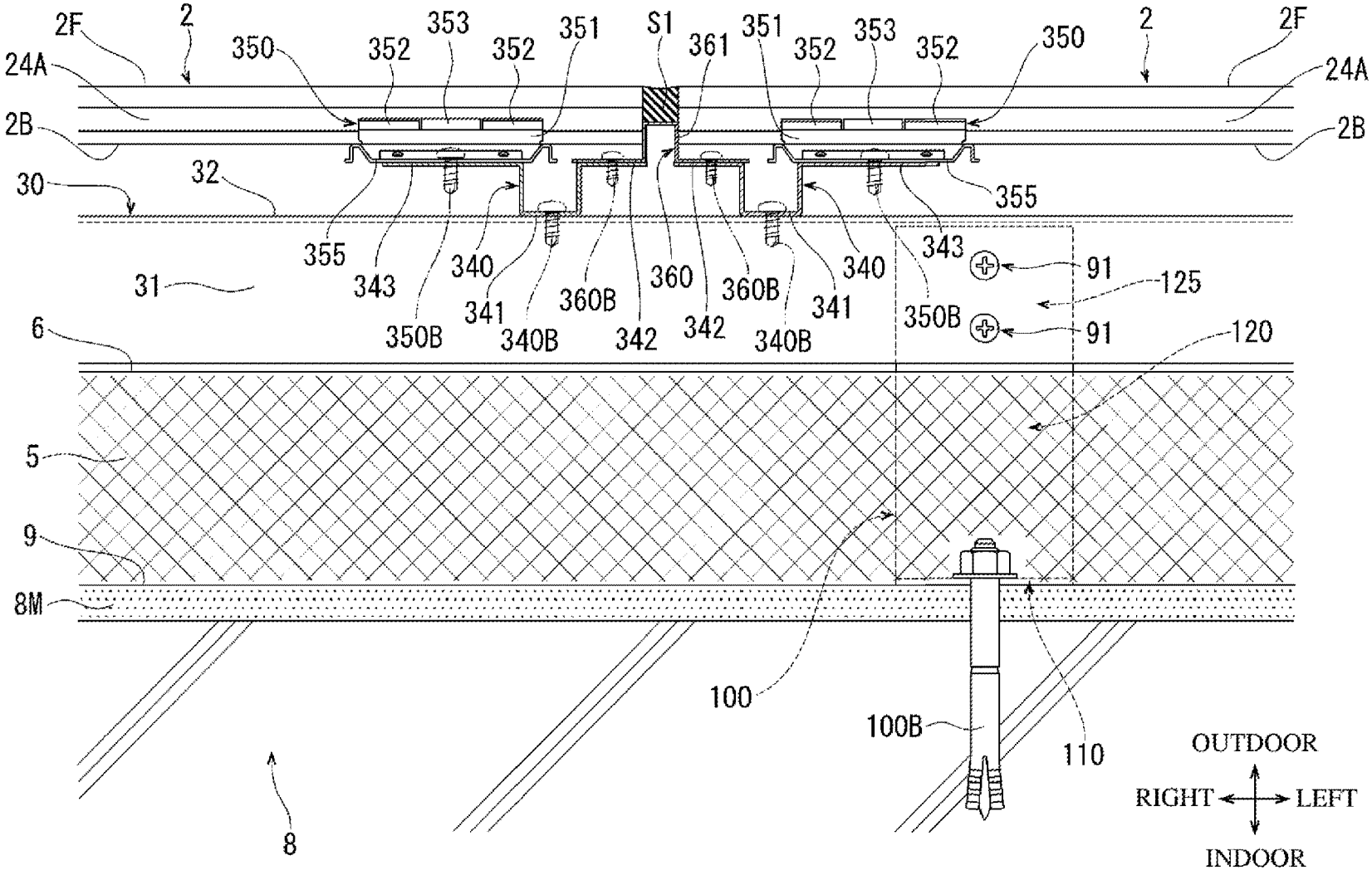
FIG. 13 is a partial cross-sectional view of a wall structure of a third embodiment.
Figure 14:
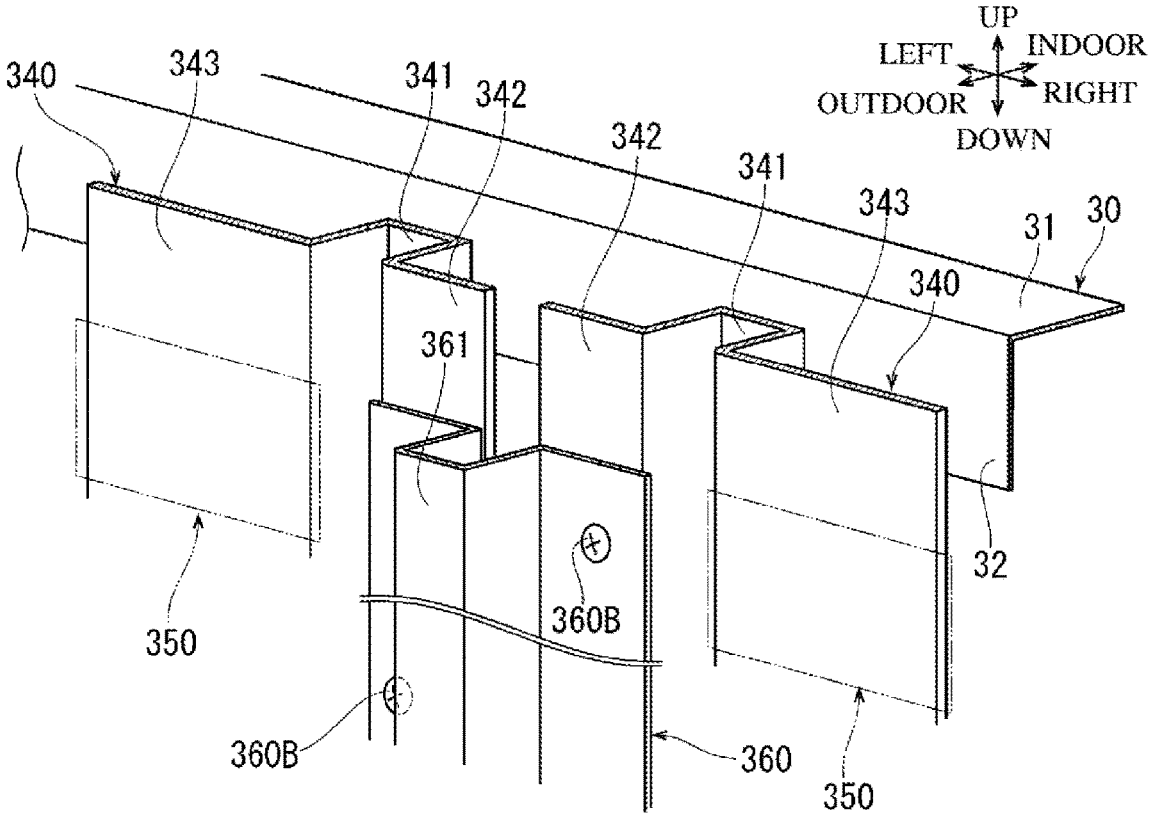
FIG. 14 is a partial perspective view according to the third embodiment.
Figure 15:
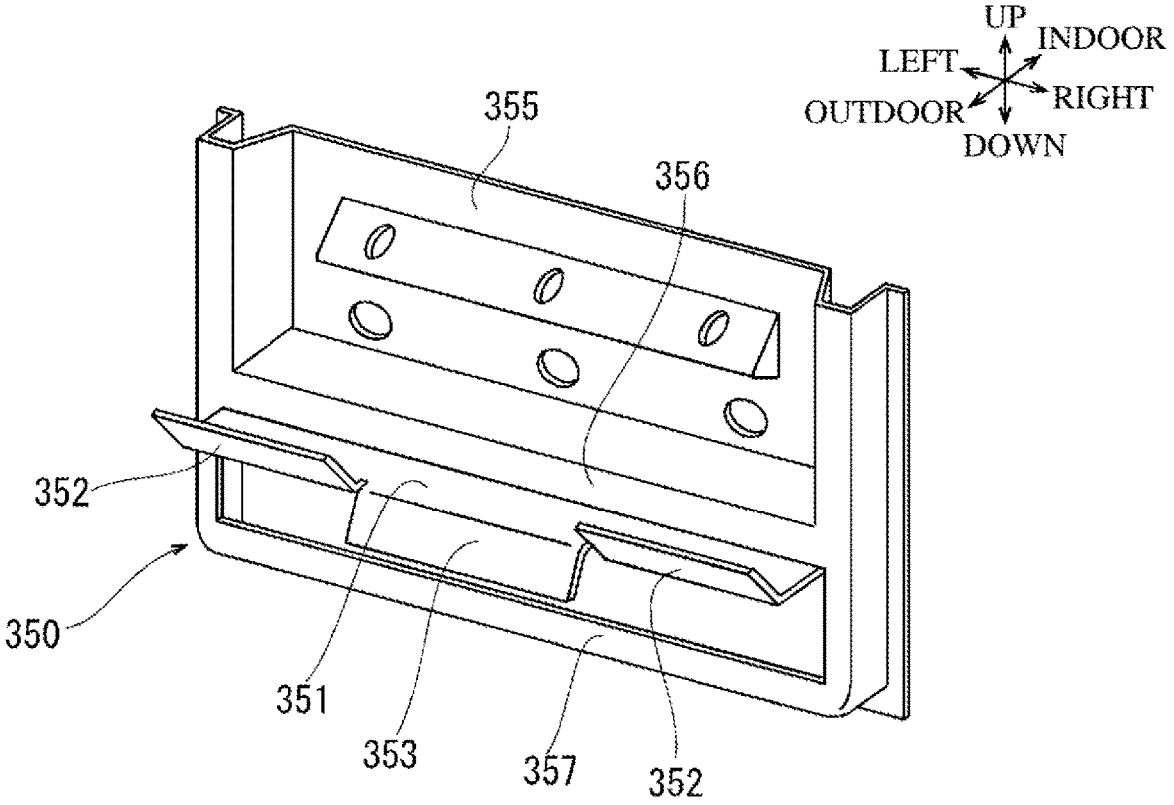
FIG. 15 is a perspective view of a second attachment tool according to the third embodiment.

As shown in FIG. 13, in a wall structure of a third embodiment, the left and right end portions of the outer wall boards 2 of the first embodiment have been changed to flat side end surfaces without the front-side left-right joining portions 21 and the back-side left-right joining portions 22. Also, in this wall structure, instead of the vertical support bodies 40 and the first attachment tools 50 according to the first embodiment, the outer wall boards 2 are attached to the wall surface 9 using left-right joining portion support bodies 340, second attachment tools 350, and joiners 360, as shown in FIGS. 13 to 15. Other configurations of the third embodiment are the same as those of the first embodiment. For this reason, configurations identical to those of the first embodiment will be denoted by reference numerals identical thereto, and description thereof will be omitted or simplified.

As shown in FIGS. 13 and 14, the left-right joining portion support bodies 340 are elongated board materials having an inverted hat-shaped cross-section. The left-right joining portion support bodies 340 include attachment board portions 341, first support board portions 342, and second support board portions 343. The first support board portion 342 is connected with a level difference to one side edge of the flat board-shaped attachment board portion 341 and extends in a flat board shape in the direction away from the attachment board portion 341. The second support board portion 343 is connected with a level difference to the other side edge of the flat board-shaped attachment board portion 341 and extends in a flat board shape in the direction away from the attachment board portion 341 and the first support board portion 342. The second support board portion 343 is wider than the first support board portion 342. The left-right joining portion support body 340 is an example of a second support body.

The multiple left-right joining portion support bodies 340 are arranged on the wall surface 9 in a state of extending in the up-down direction on the outdoor side with respect to the second joining portion 32 of the horizontal support body 30, along the wall surface 9. Also, the left-right joining portion support bodies 340 are arranged at positions corresponding to the left end portion of the outer wall board 2 and positions corresponding to the right end portion of the outer wall board 2. Then, as shown in FIG. 13, the attachment board portions 341 of the left-right joining portion support bodies 340 and the second joining portion 32 of the horizontal support body 30 are fastened to each other using screws 340B.

As shown in FIGS. 13 and 14, the first support board portions 342 of the two left-right joining portion support bodies 340 located at the positions corresponding to the left end portion and the right end portion of the outer wall boards 2 are adjacent to each other. The joiner 360 is fastened to the first support board portions 342 by screws 360B. The joiner 360 is an elongated board material having a hat-shaped cross-section. The joiner 360 includes a protruding portion 361 that has an approximately C-shaped cross-section and protrudes in the outdoor direction.

The second support board portion 343 of the left-right joining portion support body 340 located at the position corresponding to the left end portion of the outer wall board 2 is separated leftward from the joiner 360. The second support board portion 343 of the left-right joining portion support body 340 located at the position corresponding to the right end portion of the outer wall board 2 is separated rightward from the joiner 360. The second attachment tools 350 are fastened to the second support board portion 343 by the screws 350B.

As shown in FIG. 15, the second attachment tool 350 includes a second fixing portion 355, a second upper contact portion 356, a second lower contact portion 357, a second bearing portion 351, a second upper locking portion 352, and a second lower locking portion 353. The second fixing portion 355 forms a flat surface that can come into contact with the second support board portion 343 of the left-right joining portion support body 340. The second upper contact portion 356 bulges in the outdoor direction away from the second fixing portion 355. The second lower contact portion 357 bulges in the outdoor direction away from the second fixing portion 355 at a position below the second upper contact portion 356. The second bearing portion 351 protrudes in the outdoor direction from the second fixing portion 355 between the second upper contact portion 356 and the second lower contact portion 357 and extends in the left-right direction. Both end portions of the second upper contact portion 356 and both end portions of the second lower contact portion 357 are connected so as to surround the second bearing portion 351. The second upper locking portion 352 protrudes upward from the leading end portion of the second bearing portion 351. The second lower locking portion 353 protrudes downward from the leading end portion of the second bearing portion 351.

That is, the second attachment tool 350 has a configuration similar to that of the first attachment tool 50, except that the second attachment tool 350 does not have a portion equivalent to the standing piece 59 of the first attachment tool 50 according to the first embodiment. For this reason, although description is simplified, as shown in FIG. 13, the second attachment tool 350 supports the up-down shiplap portion of the outer wall boards 2 that are adjacent in the up-down direction, similarly to the first attachment tool 50.

The protruding portion 361 of the joiner 360 is arranged between the mutually opposing side end surfaces of the outer wall boards 2 that are adjacent in the left-right direction of the outer wall board 2, and the space surrounded by the side end surfaces and the protruding portion 361 is filled with a sealing material S1. The protruding portion 361 of the joiner 360 also prevents horizontal shifting of the outer wall boards 2.

With the wall structure and the construction method for the outer wall boards 2 of the third embodiment, each outer wall board 2 can be fixed, and therefore the construction is simple and fast, and the outer wall boards 2 can be stably supported.

Fourth Embodiment

As shown in FIGS. 16 to 19, in a wall structure of a fourth embodiment, multiple vertical support bodies 430 are arranged on the wall surface 9 in a state of being separated from each other at a predetermined interval in the left-right direction, and extending in the up-down direction along the wall surface 9. The vertical support bodies 430 are arranged extending across at least two brackets 100. The outer wall boards 2 are attached directly to the side of at least two vertical support bodies 430 that is opposite to the wall surface 9, and are arranged directly on the second joining portions 432 of the vertical support bodies 430. The vertical support body 430 is an example of a first support body. In the fourth embodiment, the first direction is the up-down direction. Other configurations of the fourth embodiment are the same as those of the first embodiment and the like. For this reason, configurations identical to those of the first embodiment and the like will be denoted by reference numerals identical thereto, and description thereof will be omitted or simplified.

The vertical support body 430 is an elongated molded material having a quadrangular tube-shaped cross-section. In the present embodiment, the vertical support body 430 is a rectangular steel pipe. Note that the material and manufacturing method of the vertical support body 430 are not limited to those described above, and various types of materials including resin, wood, and the like, and manufacturing methods can be selected as appropriate.

The vertical support body 430 includes a first joining portion 431 and a second joining portion 432. The vertical support body 430 includes a pair of board-shaped portions that extend in the indoor-outdoor direction and the up-down direction, and the board-shaped portion located on the right among those board-shaped portions is a first joining portion 431. Also, the vertical support body 430 includes a pair of board-shaped portions that extend in the left-right direction and the up-down direction, and the board-shaped portions located on the side opposite to the wall surface 9 among those board-shaped portions is a second joining portion 432. That is, the second joining portion 432 is connected to one edge of the flat board-shaped first joining portion 431 and extends in a flat board shape in a direction approximately orthogonal to the first joining portion 431.

In the fourth embodiment, the orientation of the bracket 100 according to the first embodiment is changed for use. That is, in the fourth embodiment, the fixing portion 115 of the bracket 100 is fixed to the wall surface 9 in a state in which the mounting portion 125 of the bracket 100 extends in the indoor-outdoor direction and the up-down direction, and the mounting surface 126 is a leftward-facing plane.

Figure 19:
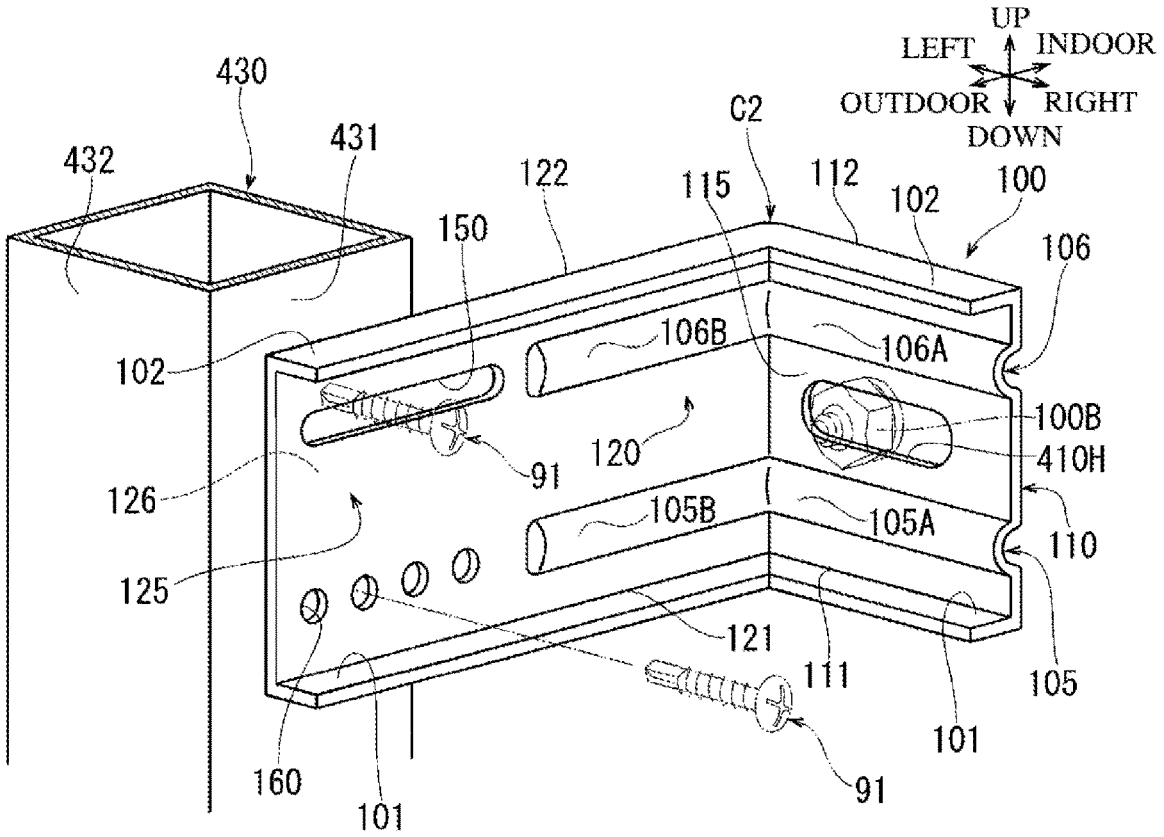
FIG. 19 is a perspective view of a bracket and a first support body according to the fourth embodiment.

At this time, as shown in FIG. 19 and the like, with the fourth embodiment, the round hole 110H according to embodiment 1 is changed to an elongated hole 410H. Accordingly, the fixing portion 115 can be fixed to the wall surface 9 while adjusting the position of the bracket 100 in the left-right direction.

In the bracket 100 according to the fourth embodiment, a main elongated hole 150 and multiple main circular holes 160 are provided in the mounting portion 125. The bracket 100 according to the fourth embodiment is an example of an attachment apparatus.

The main elongated hole 150 extends in the outdoor direction away from the fixing portion 115. The longitudinal direction of the main elongated hole 150 is the indoor-outdoor direction. In the present embodiment, the main elongated hole 150 is arranged on an extended line of the rib 106B.

The main circular holes 160 are arranged at positions separated from the main long hole 150 in a direction intersecting the longitudinal direction of the main long hole 150, that is, in the up-down direction. The main circular holes 160 are aligned in the indoor-outdoor direction. In the present embodiment, the main circular holes 160 are arranged on an extended line of the rib 105B.

The construction method for the outer wall boards 2 of the fourth embodiment is implemented through first to fourth steps.

As shown in FIGS. 16 to 19, in the first step, the multiple brackets 100 are arranged on the wall surface 9 by fixing the fixing portion 115 to the structural body 8 using an anchor bolt 100B in a state in which the mounting surface 126 is a leftward-facing plane.

In the second step, the multiple vertical support bodies 430 are put in a state of extending in the up-down direction along the wall surface 9 and being arranged extending across at least two brackets 100. At this time, the first joining portions 431 of the vertical support bodies 430 are mounted to the left of the mounting surfaces 126 of the brackets 100.

In the third step, the mounting portions 125 of the brackets 100 and the first joining portions 431 of the vertical support bodies 430 are fastened to each other by the first drill screws 91. The direction of fastening the first drill screws 91 has been changed to leftward in the fourth embodiment.

At this time, as shown in FIG. 19, the vertical support body 430 can be temporarily fastened to the mounting portion 125 by inserting the first drill screw 91 into the main elongated hole 150 of the mounting portion 125 and then shallowly screwing the first drill screw 91 into the first joining portion 431. Also, in this state, the mounting portion 125 and the first joining portion 431 can be reliably fastened to each other by positioning the vertical support body 430 through shifting in the indoor-outdoor direction, and thereafter completely screwing the first drill screw 91 into the first joining portion 431. As a result, the positioning of the vertical support body 430 for adjusting unevenness of the wall surface 9 can be performed precisely and easily, and thus simplification of the task can be realized.

Next, the mounting portion 125 and the first joining portion 431 can be even more reliably fastened to each other by inserting another first drill screw 91 into a main circular hole 160 of the mounting portion 125 and screwing the other first drill screw 91 into the first joining portion 431. At this time, the other first drill screw 91 need not drill a pilot hole in the mounting portion 125, and therefore the fastening task performed by the other first drill screw 91 can be performed easily.

Figure 16:
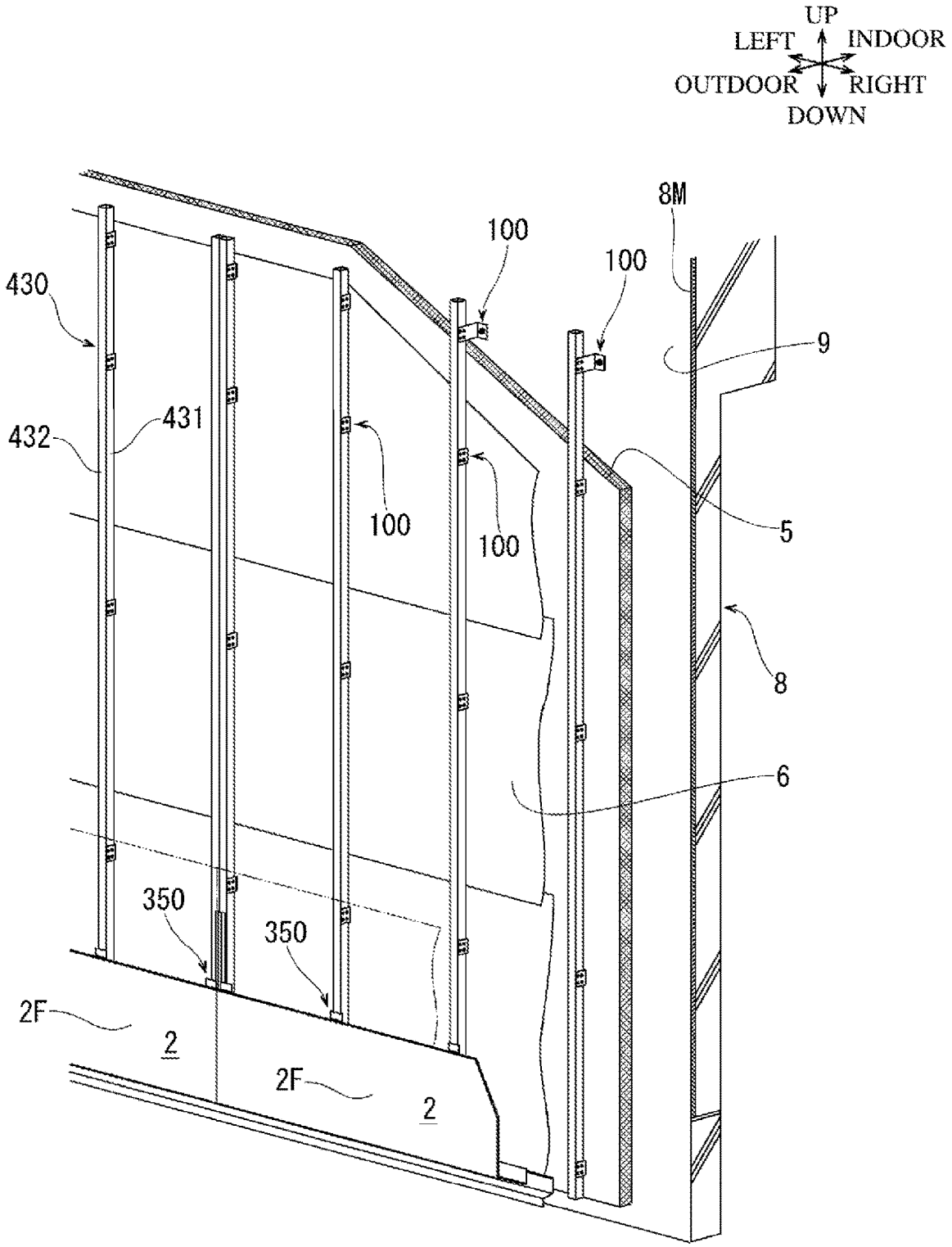
FIG. 16 is a perspective view of a wall structure for a building of a fourth embodiment.
Figure 17:
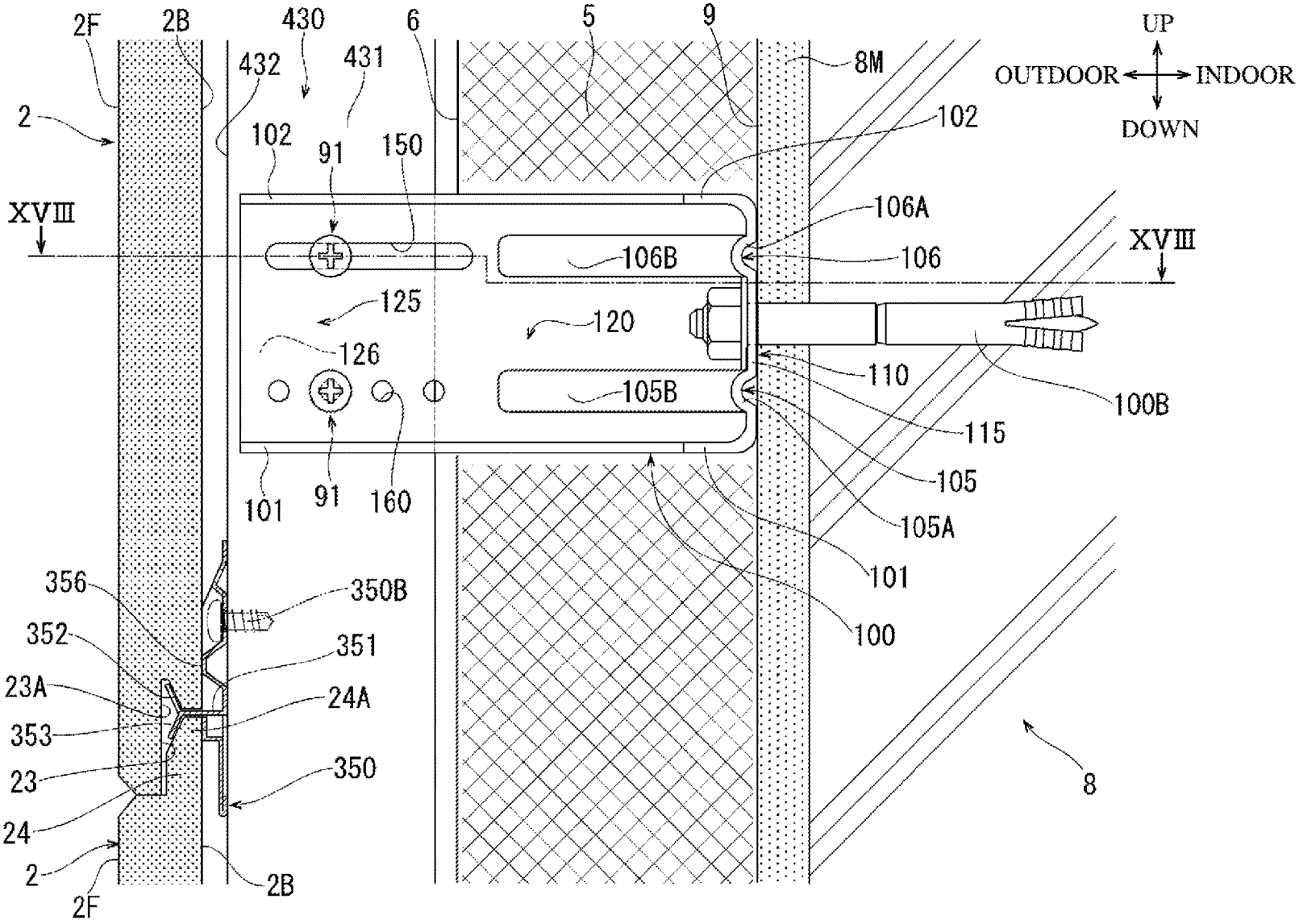
FIG. 17 is a partial cross-sectional view of the wall structure of the fourth embodiment.
Figure 18:
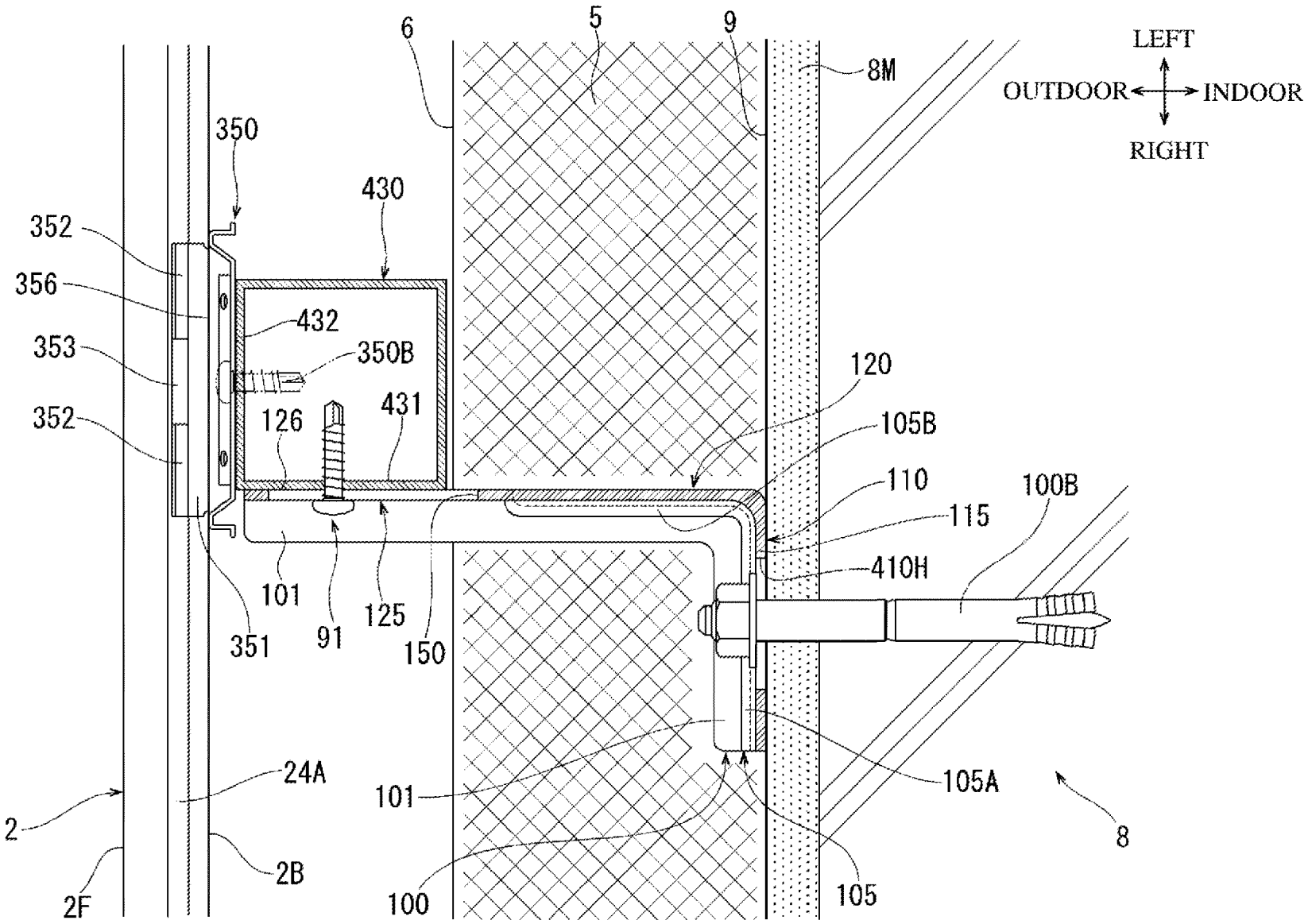
FIG. 18 is a cross-sectional view showing a cross-section taken along XVIII-XVIII in FIG. 17.

As shown in FIGS. 16 to 18, in the fourth step, the second attachment tool 350 according to the third embodiment is fastened to the second joining portion 432 of the vertical support body 430 by the screw 350B, and the multiple outer wall boards 2 are attached by the second attachment tool 350 to the side of at least two vertical support bodies 430 that is opposite to the wall surface 9, and cover the wall surface 9.

Accordingly, with the wall structure and the construction method for the outer wall boards 2 of the fourth embodiment, construction is simple and fast, and the outer wall boards 2 can be stably supported.

Fifth Embodiment

Figure 20:
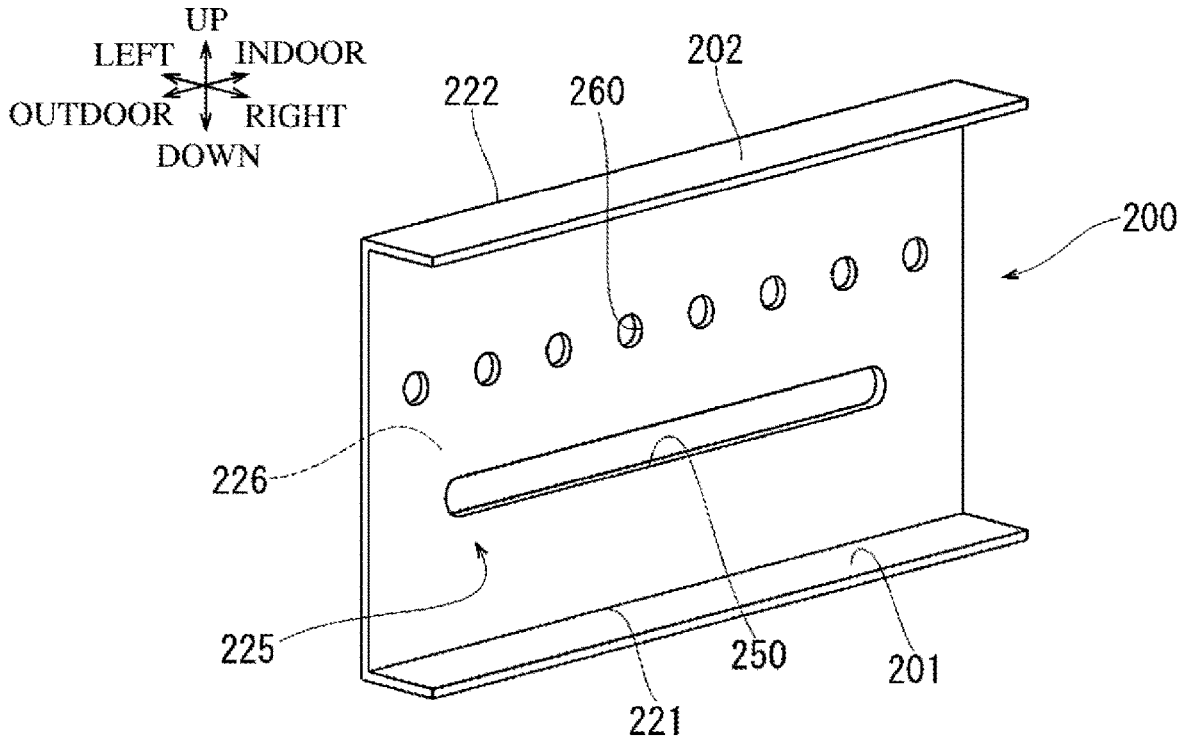
FIG. 20 is a perspective view of an extension member according to a fifth embodiment.
Figure 21:
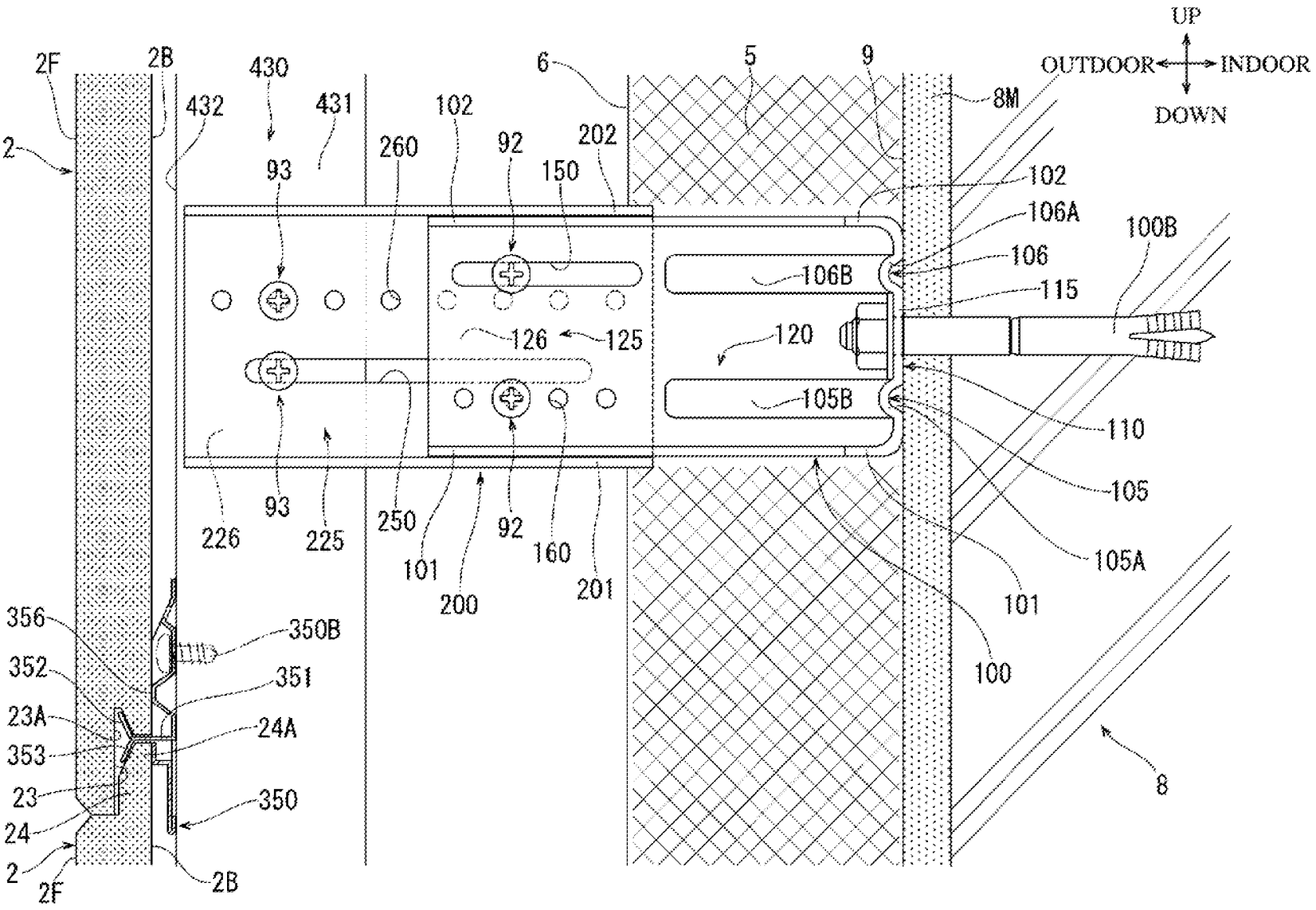
FIG. 21 is a partial cross-sectional view of a wall structure of the fifth embodiment.
Figure 22:
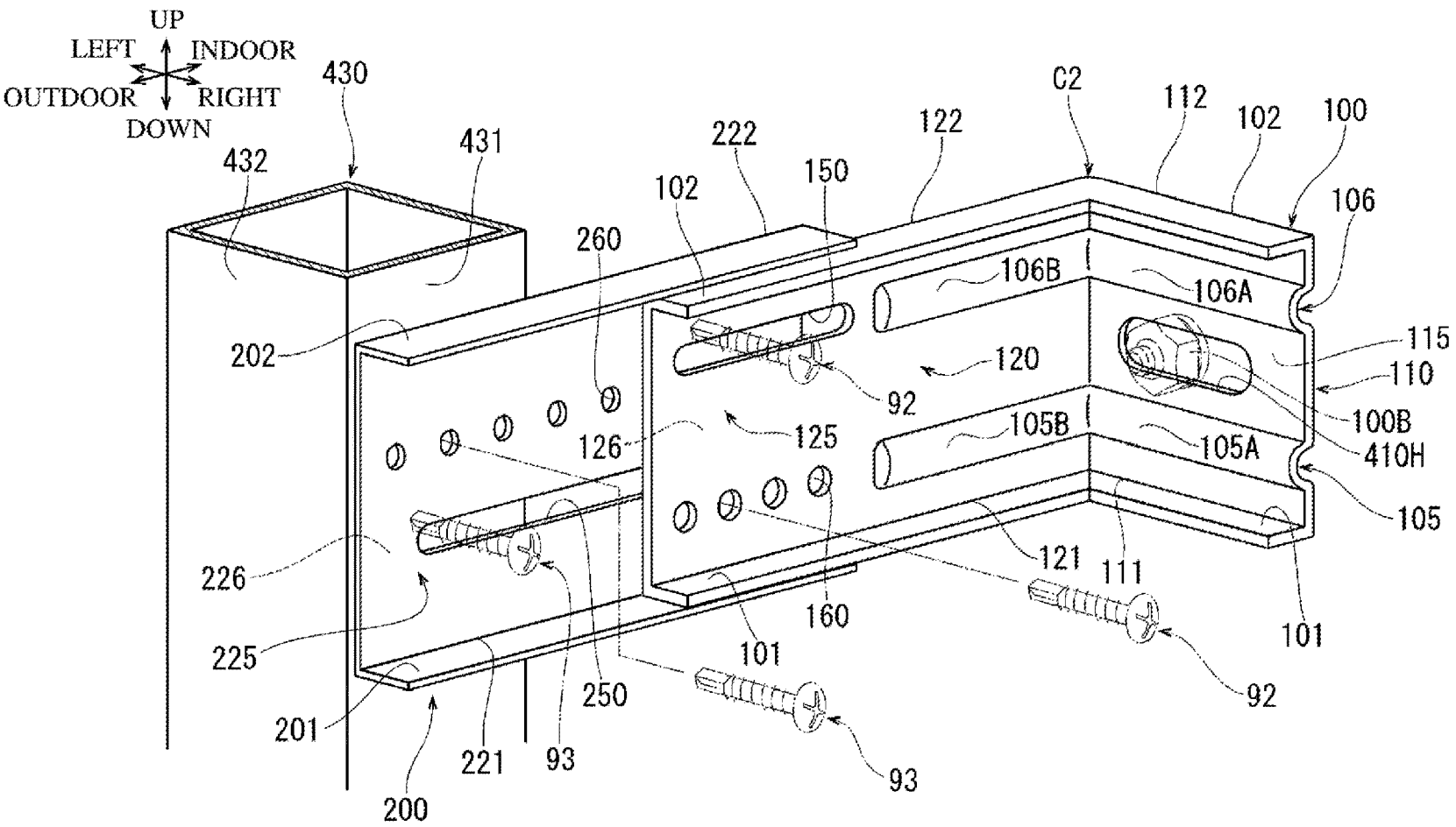
FIG. 22 is a perspective view of a bracket, the extension member, and a first support body according to the fifth embodiment.

As shown in FIGS. 20 to 22, in a wall structure of a fifth embodiment, a case is shown in which the unevenness of the wall surface 9 is so significant that the unevenness of the wall surface 9 cannot be adjusted with the positioning of the first joining portion 431 of the vertical support body 430 with respect to the mounting surface 126 of the bracket 100 in the third step according to the fourth embodiment. In this case, the extension member 200 is arranged between the mounting portion 125 of the bracket 100 and the first joining portion 431 of the vertical support body 430 according to the fourth embodiment, and thus the significant unevenness is adjusted.

In the fifth embodiment, the orientation of the extension member 200 according to the second embodiment is changed for use. That is, in the fifth embodiment, the extension member 200 is mounted to the left of the mounting portion 125 in which the main elongated hole 150 and the main circular holes 160 are provided, in the bracket 100, in a state in which the extension mounting portion 225 extends in the indoor-outdoor direction and the up-down direction and the extension mounting surface 226 is a leftward-facing flat surface.

In the extension member 200 according to the fifth embodiment, an auxiliary elongated hole 250 and a plurality of auxiliary circular holes 260 are provided in the extension mounting portion 225. The bracket 100 and the extension member 200 according to the fifth embodiment are examples of attachment apparatuses.

The auxiliary elongated hole 250 extends in the outdoor direction away from the first portion 110 of the bracket 100. The longitudinal direction of the auxiliary elongated hole 250 is the indoor-outdoor direction.

The auxiliary circular holes 260 are arranged at positions separated from the auxiliary elongated hole 250 in a direction intersecting the longitudinal direction of the auxiliary elongated hole 250, that is, in the up-down direction. The auxiliary circular holes 260 are aligned in the indoor-outdoor direction.

As shown in FIG. 21, the auxiliary elongated hole 250 and the auxiliary circular holes 260 are arranged at positions shifted downward with respect to the main elongated hole 150 of the mounting portion 125. Also, the auxiliary elongated hole 250 and the auxiliary circular holes 260 are arranged at positions shifted upward with respect to the main circular holes 160 of the mounting portion 125.

In other words, the auxiliary elongated hole 250 and the auxiliary circular holes 260 are arranged at positions that do not overlap with the main elongated hole 150 of the mounting portion 125. Also, the auxiliary elongated hole 250 and the auxiliary circular holes 260 are arranged at positions that do not overlap with the main circular holes 160 of the mounting portion 125.

In the third step of the construction method for the outer wall boards 2 of the fifth embodiment, the mounting portion 125 of the bracket 100 and the extension mounting portion 225 of the extension member 200 are fastened to each other by the second drill screws 92. The direction of fastening the second drill screws 92 has been changed to leftward in the fifth embodiment.

At this time, as shown in FIG. 22, the extension member 200 can be temporarily fastened to the mounting portion 125 by inserting the second drill screw 92 into the main elongated hole 150 of the mounting portion 125 and shallowly screwing the second drill screw 92 into the extension mounting portion 225. Then, in this state, the mounting portion 125 and the extension mounting portion 225 can be reliably fastened to each other by positioning the extension member 200 through shifting in the indoor-outdoor direction and thereafter completely screwing the second drill screw 92 into the extension mounting portion 225.

Next, the mounting portion 125 and the extension mounting portion 225 can be even more reliably fastened to each other by inserting another second drill screw 92 into the main circular hole 160 of the mounting portion 125 and screwing the other second drill screw 92 into the extension mounting portion 225. At this time, the other second drill screw 92 need not drill a pilot hole in the mounting portion 125, and therefore the fastening task performed using the other second drill screw 92 can be performed easily.

Next, the extension mounting portion 225 of the extension member 200 and the first joining portion 431 of the vertical support body 430 are fastened to each other by the third drill screw 93. The direction of fastening the third drill screw 93 has also been changed to leftward.

At this time, the vertical support body 430 is temporarily fastened to the extension mounting portion 225 by inserting the third drill screw 93 into the auxiliary elongated hole 250 of the extension mounting portion 225 and thereafter shallowly screwing the third drill screw 93 into the first joining portion 431. Then, in this state, the extension mounting portion 225 and the first joining portion 431 can be reliably fastened to each other by positioning the vertical support body 430 through shifting in the indoor-outdoor direction and thereafter completely screwing the third drill screw 93 into the first joining portion 431. As a result, the positioning of the vertical support body 430 for adjusting unevenness of the wall surface 9 can be performed efficiently and easily, and thus simplification of the task can be realized.

Next, the extension mounting portion 225 and the first joining portion 431 can be even more reliably fastened to each other by inserting another third drill screw 93 into the auxiliary circular hole 260 of the extension mounting portion 225 and screwing the other third drill screw 93 into the first joining portion 431. At this time, the other third drill screw 93 need not drill a pilot hole in the extension mounting portion 225, and therefore the fastening task performed using the other third drill screw 93 can be performed easily.

Here, the auxiliary elongated hole 250 and the auxiliary circular holes 260 are arranged at positions shifted with respect to the main elongated hole 150 of the mounting portion 125. Also, the auxiliary elongated hole 250 and the auxiliary circular holes 260 are arranged at positions shifted with respect to the main circular holes 160 of the mounting portion 125. Accordingly, the main elongated hole 150 and main circular holes 160, and the auxiliary elongated hole 250 and auxiliary circular holes 260 do not hinder each other's effects. As a result, the positioning of the vertical support body 430 for unevenness adjustment of the wall surface 9 can be performed even more efficiently and easily, and even greater simplification of the task can be realized.

Accordingly, with the wall structure and the construction method for the outer wall boards 2 of the fifth embodiment as well, construction is simple and fast, and the outer wall boards 2 can be stably supported.

Sixth Embodiment

Figure 23:
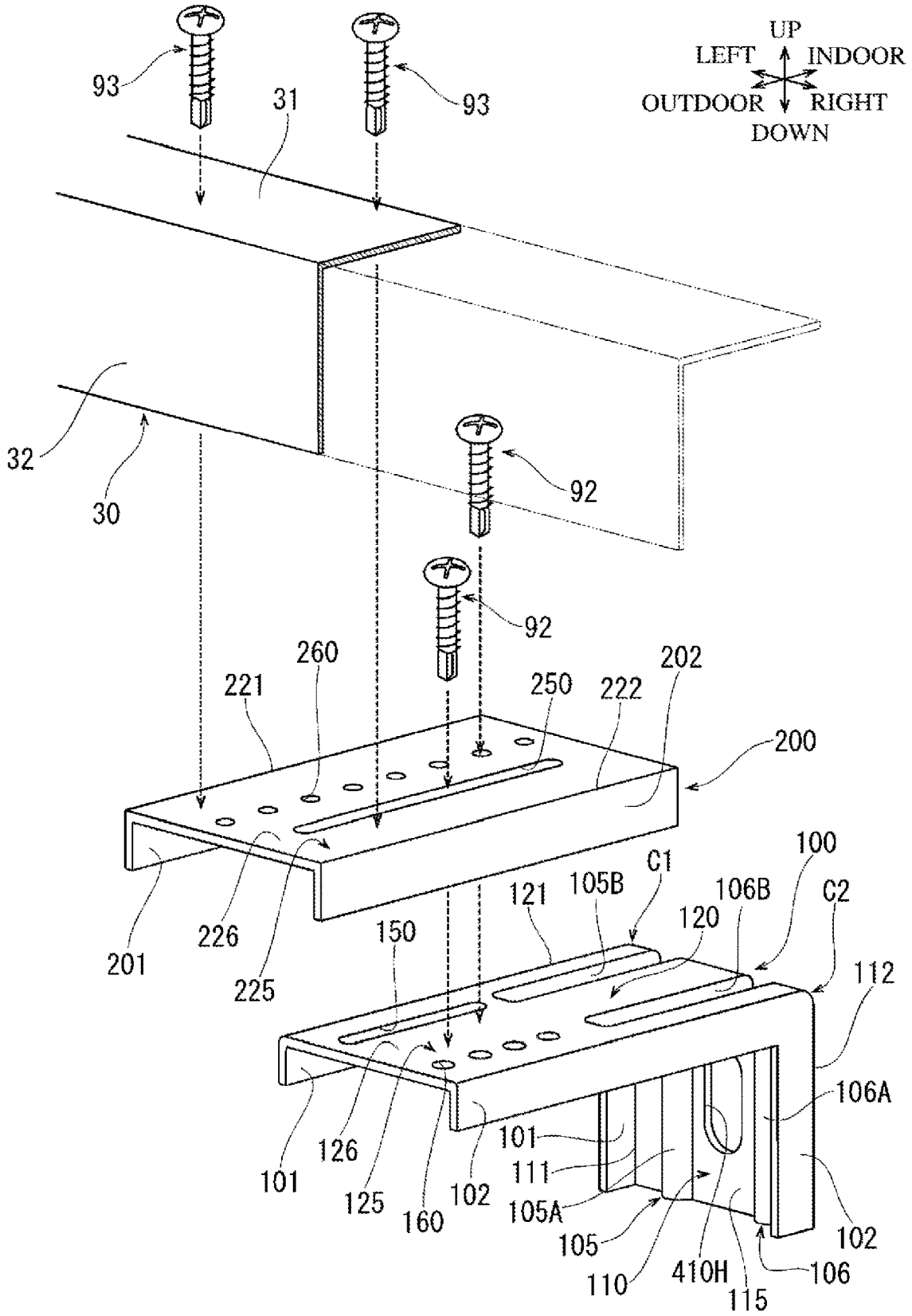
FIG. 23 is a perspective view of a bracket, an extension member, and a first support body according to a sixth embodiment.
Figure 24:
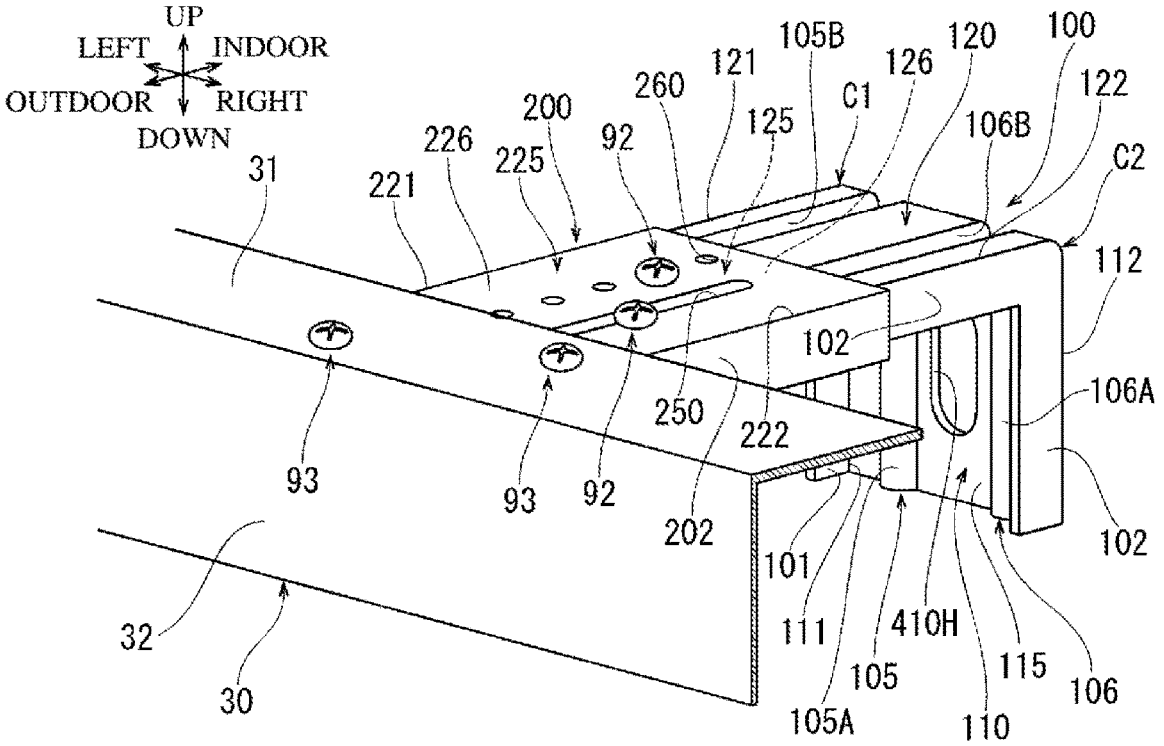
FIG. 24 is a perspective view of the bracket, the extension member, and the first support body according to the sixth embodiment.

As shown in FIGS. 23 and 24, with the wall structure of a sixth embodiment, the horizontal support body 30 of the first embodiment is supported using the bracket 100 and the extension member 200 according to the fifth embodiment. In the sixth embodiment, the first direction is the left-right direction. Also, the orientations of the bracket 100 and the extension member 200 according to the fifth embodiment are changed to be the same as the orientations of the bracket 100 and the extension member 200 according to the second embodiment. That is, the extension mounting portion 225 of the extension member 200 is mounted on the mounting portion 125 of the bracket 100. The first joining portion 31 of the horizontal support body 30 is mounted on the extension mounting portion 225 of the extension member 200. Also, the direction of fastening the second drill screws 92 and the direction of fastening the third drill screws 93 are downward.

In the third step of the construction method for the outer wall boards 2 of the sixth embodiment, the mounting portion 125 of the bracket 100 and the extension mounting portion 225 of the extension member 200 that overlaps the mounting portion 125 from above are fastened to each other by the second drill screws 92.

At this time, as shown in FIG. 23, the extension member 200 can be temporarily fastened to the mounting portion 125 by inserting the second drill screw 92 into the auxiliary elongated hole 250 of the extension mounting portion 225 and thereafter shallowly screwing the second drill screw 92 into the mounting portion 125. Then, in this state, the mounting portion 125 and the extension mounting portion 225 can be reliably fastened to each other by positioning the extension member 200 through shifting in the indoor-outdoor direction and then completely screwing the second drill screw 92 into the mounting portion 125.

Next, the mounting portion 125 and the extension mounting portion 225 can be even more reliably fastened to each other by inserting another second drill screw 92 into an auxiliary circular hole 260 of the extension mounting portion 225 and screwing the other second drill screw 92 into the mounting portion 125.

Next, the extension mounting portion 225 of the extension member 200 and the first joining portion 31 of the horizontal support body 30 that overlaps the extension mounting portion 225 from above are fastened to each other by the third drill screw 93 at a position that does not overlap with the auxiliary elongated hole 250 and the auxiliary circular holes 260 of the extension mounting portion 225.

Accordingly, with the wall structure and the construction method for the outer wall boards 2 of the sixth embodiment as well, construction is simple and fast, and the outer wall boards 2 can be stably supported.

Modified Example of Bracket

Figure 25:
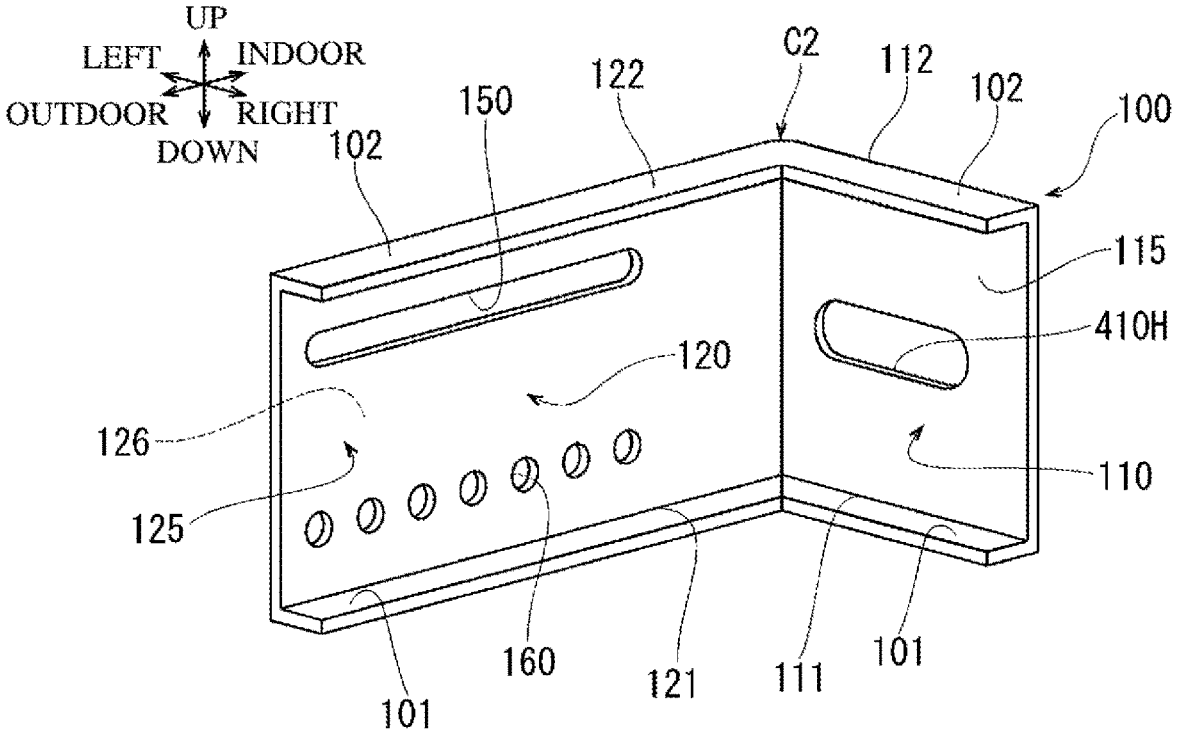
FIG. 25 is a perspective view showing a modified example of a bracket.

As shown in FIG. 25, a configuration in which the protruding portions 105 and 106 have been removed is also encompassed in the present invention as a modified example of the bracket 100 according to the fourth to sixth embodiments, that is, the bracket 100 in which the main elongated hole 150 and the main circular holes 160 are provided in the mounting portion 125. The present invention also encompasses a configuration in which the main elongated hole 150 and the main circular holes 160 have been removed from the bracket 100 of the modified example shown in FIG. 25, although this is not shown in the drawings.

In the description above, the embodiments of the present invention were described in conformity with first to sixth embodiments, but it goes without saying that the embodiments of the present invention is not limited to the above-described first to sixth embodiments, and can be applied with modifications as appropriate, without departing from the gist.

For example, in the first to third and sixth embodiments, the first direction is the left-right direction, but there is no limitation to this configuration, and the first direction may also be the up-down direction, as in the fourth and fifth embodiments. The same also applies to the second direction.

Configurations in which the first side wall portion 101 according to the first embodiment is changed as follows are also encompassed in the present invention. That is, the first side wall portion 101 can be changed to a configuration in which the first side wall portion 101 extends continuously from a position shifted upward with respect to the lower end of the left side edge 111 of the first portion 110 to a position shifted toward the fixing portion 115 with respect to the leading end of the left side edge 121 of the second portion 120, and protrudes toward the narrow angle α1 side. The same applies to the second side wall portion 102.

The present invention also encompasses a configuration in which the first attachment tool 50 according to the first embodiment and the second attachment tool 350 according to the second embodiment are not used, and the outer wall board 2 is fixed directly to the vertical support body 40 using a screw, a nail, or the like.

LIST OF REFERENCE NUMERALS

9 Wall surface
8 Structural body
100 Bracket
30 First support body (horizontal support body)
91, 92, 93 Fastening member (91: First drill screw, 92: Second drill screw, 93: Third drill screw)
40, 340 Second support body (40: Vertical support body, 340: Left-right joining portion support body)
2 Board material (outer wall board)
115 Fixing portion
110 First portion
120 Second portion
111 One side edge of first portion (left-side edge of first portion)
121 One side edge of second portion (left-side edge of second portion)
α1 Narrow angle of angle formed by first portion and second portion
101 First side wall portion
112 Other side edge of first portion (right-side edge of first portion)
122 Other side edge of second portion (right-side edge of second portion)
102 Second side wall portion
126 Mounting surface
125 Mounting portion
31 First joining portion
32 Second joining portion
105, 106 Protruding portion
H1 First height
H2 Second height
200 Extension member
226 Extension mounting surface

225 Extension mounting portion
221 One side edge of extension mounting portion (left-side edge of extension mounting portion)
201 First extension side wall portion
222 Other side edge of extension mounting portion (right-side edge of extension mounting portion)
202 Second extension side wall portion
2B Back surface of board material (back surface of outer wall board)
2F Front surface of board material (front surface of outer wall board)
23 First shiplap joining portion of board material (front-side up-down joining portion)
24 Second shiplap joining portion of board material (back-side up-down joining portion)
22 Third shiplap joining portion of board material (back-side left-right joining portion)
21 Fourth shiplap joining portion of board material (front-side left-right joining portion)
150 Main elongated hole
160 Main circular hole
250 Auxiliary elongated hole
260 Auxiliary circular hole

The invention claimed is:

1. A wall structure for a building, the wall structure comprising:
a structural body forming a wall surface;
a plurality of brackets arranged on the wall surface;
a plurality of first support bodies that extend in a first direction along the wall surface and are arranged extending across at least two of the brackets;
fastening members configured to fasten the brackets and the first support bodies to each other; and
a plurality of board materials configured to be attached directly or indirectly to a side of at least two of the first support bodies that is opposite to the wall surface, and to cover the wall surface, wherein
the brackets each include:
a first portion including a fixing portion configured to be fixed to the structural body;
a second portion that is bent at an approximate right angle from the first portion and extends away from the fixing portion;
a first side wall portion that extends continuously from at least a portion of one side edge of the first portion to at least a portion of one side edge of the second portion, and protrudes toward a narrow angle side of an angle formed by the first portion and the second portion;
a second side wall portion that extends continuously from at least a portion of another side edge of the first portion to at least a portion of another side edge of the second portion, and protrudes toward the narrow angle side; and
a mounting portion including a mounting surface that is provided on the second portion and faces a side opposite to the side to which the first side wall portion and the second side wall portion protrude,
the first support bodies each include:
a first joining portion configured to be mounted on the mounting surface; and
a second joining portion on which the board materials are to be arranged directly or indirectly, and
the fastening members include first drill screws configured to fasten the mounting portions and the first joining portions to each other in a direction perpendicular to the mounting surface, wherein
the brackets each include a protruding portion that extends continuously from at least a portion of the first portion to at least a portion of the second portion and protrudes toward the narrow angle side, and
the protruding portion extends to the approximate center of the second portion, and the mounting surface is a flat surface formed in an area of the second portion that is farther from the first portion than the protruding portion.

2. The wall structure for a building according to claim 1, comprising
a plurality of second support bodies that extend in a second direction intersecting the first support bodies along the wall surface and are arranged extending across at least two of the first support bodies,
wherein the second support bodies are arranged on the second joining portions, and
the board materials are attached to at least two of the second support bodies.

3. The wall structure for a building according to claim 1, wherein
a first height to which the protrusion portion protrudes with respect to the mounting surface is set to be less than or equal to a second height to which the first side wall portion and the second side wall portion protrude with respect to the mounting surface.

4. The wall structure for a building according to claim 1, wherein
the mounting portion is provided with a main elongated hole that extends away from the fixing portion.

5. The wall structure for a building according to claim 4, wherein
the mounting portion is provided with at least one main circular hole arranged at a position away from the main elongated hole in a direction intersecting a longitudinal direction of the main elongated hole.

6. A wall structure for a building the wall structure comprising:
a structural body forming a wall surface;
a plurality of brackets arranged on the wall surface;
a plurality of first support bodies that extend in a first direction along the wall surface and are arranged extending across at least two of the brackets;
fastening members configured to fasten the brackets and the first support bodies to each other;
a plurality of board materials configured to be attached directly or indirectly to a side of at least two of the first support bodies that is opposite to the wall surface, and to cover the wall surface; and
an extension member configured to be arranged between the mounting portion of the bracket and the first joining portion of the first support body, wherein
the brackets each include:
a first portion including a fixing portion configured to be fixed to the structural body;
a second portion that is bent at an approximate right angle from the first portion and extends away from the fixing portion;
a first side wall portion that extends continuously from at least a portion of one side edge of the first portion to at least a portion of one side edge of the second portion, and protrudes toward a narrow angle side of an angle formed by the first portion and the second portion;
a second side wall portion that extends continuously from at least a portion of another side edge of the first portion to at least a portion of another side edge of the second portion, and protrudes toward the narrow angle side; and a mounting portion including a mounting surface that is provided on the second portion and faces a side opposite to the side to which the first side wall portion and the second side wall portion protrude, the first support bodies each include:

a first joining portion configured to be mounted on the mounting surface; and a second joining portion on which the board materials are to be arranged directly or indirectly, the fastening members include first drill screws configured to fasten the mounting portions and the first joining portions to each other in a direction perpendicular to the mounting surface, the extension member includes:

an extension mounting portion that is configured to be mounted on the mounting surface, extends away from the first portion, and includes an extension mounting surface that faces the same side as the mounting surface such that the first joining portion is mounted thereon;

a first extension side wall portion that protrudes in the same direction as the first side wall portion from one side edge of the extension mounting portion, and is adjacent to the first side wall portion; and a second extension side wall portion that protrudes in the same direction as the second side wall portion from another side edge of the extension mounting portion, and is adjacent to the second side wall portion, and the fastening members include:

a second drill screw for fastening the mounting portion and the extension mounting portion to each other in a direction perpendicular to the mounting surface; and a third drill screw for fastening the extension mounting portion and the first joining portion to each other in a direction perpendicular to the extension mounting surface.

7. The wall structure for a building according to claim 6, wherein the extension mounting portion is provided with an auxiliary elongated hole that extends away from the first portion.

8. The wall structure for a building according to claim 7, wherein the extension mounting portion is provided with at least one auxiliary circular hole arranged at a position away from the auxiliary elongated hole in a direction intersecting the longitudinal direction of the auxiliary elongated hole.

9. The wall structure for a building according to claim 8, wherein the auxiliary elongated hole and the auxiliary circular hole are arranged at positions shifted with respect to the main elongated hole, and the auxiliary elongated hole and the auxiliary circular hole are arranged at positions shifted with respect to the main circular hole.

10. A wall structure for a building, the wall structure comprising:

a structural body forming a wall surface;

a plurality of brackets arranged on the wall surface;

a plurality of first support bodies that extend in a first direction along the wall surface and are arranged extending across at least two of the brackets;

fastening members configured to fasten the brackets and the first support bodies to each other; and a plurality of board materials configured to be attached directly or indirectly to a side of at least two of the first support bodies that is opposite to the wall surface, and to cover the wall surface, wherein the brackets each include:

a first portion including a fixing portion configured to be fixed to the structural body;

a second portion that is bent at an approximate right angle from the first portion and extends away from the fixing portion;

a first side wall portion that extends continuously from at least a portion of one side edge of the first portion to at least a portion of one side edge of the second portion, and protrudes toward a narrow angle side of an angle formed by the first portion and the second portion;

a second side wall portion that extends continuously from at least a portion of another side edge of the first portion to at least a portion of another side edge of the second portion, and protrudes toward the narrow angle side; and a mounting portion including a mounting surface that is provided on the second portion and faces a side opposite to the side to which the first side wall portion and the second side wall portion protrude, the first support bodies each include:

a first joining portion configured to be mounted on the mounting surface; and a second joining portion on which the board materials are to be arranged directly or indirectly, the fastening members include first drill screws configured to fasten the mounting portions and the first joining portions to each other in a direction perpendicular to the mounting surface, the board materials each have a quadrilateral shape with four first to fourth end portions, and in each of the board materials, the first end portion of the board material includes a first shiplap joining portion that is recessed from a back surface to a front surface of the board material and extends along the first end portion, the second end portion of the board material opposing the first end portion includes a second shiplap joining portion that is recessed from the front surface to the back surface of the board material and extends along the second end portion, the third end portion that intersects the first end portion and the second end portion of the board material includes a third shiplap joining portion that is recessed from the front surface to the back surface of the board material and extends along the third end portion, and the fourth end portion of the board material that opposes the third end portion includes a fourth shiplap joining portion that is recessed from the back surface to the front surface of the board material and extends along the fourth end portion.

11. An attachment apparatus comprising a bracket that can be arranged on a wall surface formed by a structural body, wherein the bracket includes:

a first portion including a fixing portion configured to be fixed to the structural body;

a second portion that is bent at an approximate right angle from the first portion and extends away from the fixing portion;

a first side wall portion that extends continuously from at least a portion of one side edge of the first portion to at least a portion of one side edge of the second portion, and protrudes toward a narrow angle side of an angle formed by the first portion and the second portion;

a second side wall portion that extends continuously from at least a portion of another side edge of the first portion to at least a portion of another side edge of the second portion, and protrudes toward the narrow angle side; and a mounting portion including a mounting surface that is provided on the second portion and faces a side opposite to the side to which the first side wall portion and the second side wall portion protrude, the mounting portion is provided with a main elongated hole that extends away from the fixing portion, at least one main circular hole is arranged at a position away from the main elongated hole in a direction intersecting the longitudinal direction of the main elongated hole, wherein the brackets each include a protruding portion that extends continuously from at least a portion of the first portion to at least a portion of the second portion and protrudes toward the narrow angle side, and the protruding portion extends to the approximate center of the second portion, and the mounting surface is a flat surface formed in an area of the second portion that is farther from the first portion than the protruding portion.

12. An attachment apparatus comprising:

a bracket that can be arranged on a wall surface formed by a structural body; and an extension member configured to be used along with the bracket, wherein the bracket includes:

a first portion including a fixing portion configured to be fixed to the structural body;

a second portion that is bent at an approximate right angle from the first portion and extends away from the fixing portion;

a first side wall portion that extends continuously from at least a portion of one side edge of the first portion to at least a portion of one side edge of the second portion, and protrudes toward a narrow angle side of an angle formed by the first portion and the second portion;

a second side wall portion that extends continuously from at least a portion of another side edge of the first portion to at least a portion of another side edge of the second portion, and protrudes toward the narrow angle side; and a mounting portion including a mounting surface that is provided on the second portion and faces a side opposite to the side to which the first side wall portion and the second side wall portion protrude, the mounting portion is provided with a main elongated hole that extends away from the fixing portion, at least one main circular hole is arranged at a position away from the main elongated hole in a direction intersecting the longitudinal direction of the main elongated hole, and the extension member includes:

an extension mounting portion that includes an extension mounting surface and is to be mounted on the mounting surface;

a first extension side wall portion that protrudes from one side edge of the extension mounting portion; and a second extension side wall portion that protrudes from another side edge of the extension mounting portion, the extension mounting portion is provided with an auxiliary elongated hole that extends in the longitudinal direction of the extension mounting surface, and at least one auxiliary circular hole is arranged at a position away from the auxiliary elongated hole in a direction intersecting the longitudinal direction of the auxiliary elongated hole, when the extension mounting portion of the extension member is mounted on the mounting surface of the bracket, the extension mounting surface faces the same side as the mounting surface, the first extension side wall portion is adjacent to the first side wall portion, and the second extension side wall portion is adjacent to the second side wall portion, the auxiliary elongated hole and the auxiliary circular hole are arranged at positions shifted with respect to the main elongated hole, and the auxiliary elongated hole and the auxiliary circular hole are arranged at positions shifted with respect to the main circular hole.

13. A board material construction method, in which a board material is attached to a structural body forming a wall surface, using a bracket, a first support body, and a fastening member, the method comprising:

a first step of arranging a plurality of the brackets on the wall surface;

a second step in which a plurality of the first support bodies are arranged extending across at least two of the brackets, extending in a first direction along the wall surface;

a third step of fastening the brackets and the first support bodies to each other using the fastening members; and a fourth step in which a plurality of the board materials are attached directly or indirectly to a side of at least two of the first support bodies that is opposite to the wall surface, and the board materials cover the wall surface, wherein the bracket includes:

a first portion that includes a fixing portion configured to be fixed to the structural body in the first step;

a second portion that is bent at an approximate right angle from the first portion and extends away from the fixing portion;

a first side wall portion that extends continuously from at least a portion of one side edge of the first portion to at least a portion of one side edge of the second portion, and protrudes toward a narrow angle side of an angle formed by the first portion and the second portion;

a second side wall portion that extends continuously from at least a portion of another side edge of the first portion to at least a portion of another side edge of the second portion, and protrudes toward the narrow angle side; and a mounting portion including a mounting surface that is provided on the second portion and faces a side opposite to the side to which the first side wall portion and the second side wall portion protrude, the first support body includes:

a first joining portion configured to be mounted on the mounting surface in the second step; and the second joining portion on which the board material is to be arranged directly or indirectly in the fourth step, and the fastening member includes a first drill screw configured to fasten the mounting portion and the first joining portion to each other in a direction perpendicular to the mounting surface in the third step, the mounting portion is provided with a main elongated hole that extends away from the fixing portion, and in the third step, the first drill screw is inserted into the main elongated hole and thereafter is shallowly screwed into the first joining portion, then the first support body is positioned through shifting in a direction of moving away from the fixing portion or the opposite direction, and then the first drill screw is completely screwed into the first joining portion.

14. The board material construction method according to claim 13, wherein the fourth step includes:

a fifth step of arranging a plurality of second support bodies in a manner extending across at least two of the first support bodies, such that the second support bodies extend in a second direction intersecting the first support bodies along the wall surface; and a sixth step of attaching the board material to at least two of the second support bodies, and in the fifth step, the second support bodies are arranged on the second joining portions of the first support bodies.

15. A board material construction method, in which a board material is attached to a structural body forming a wall surface, using a bracket, a first support body, and a fastening member, the method comprising:

a first step of arranging a plurality of the brackets on the wall surface;

a second step in which a plurality of the first support bodies are arranged extending across at least two of the brackets, extending in a first direction along the wall surface;

a third step of fastening the brackets and the first support bodies to each other using the fastening members; and a fourth step in which a plurality of the board materials are attached directly or indirectly to a side of at least two of the first support bodies that is opposite to the wall surface, and the board materials cover the wall surface, wherein the bracket includes:

a first portion that includes a fixing portion configured to be fixed to the structural body in the first step;

a second portion that is bent at an approximate right angle from the first portion and extends away from the fixing portion;

a first side wall portion that extends continuously from at least a portion of one side edge of the first portion to at least a portion of one side edge of the second portion, and protrudes toward a narrow angle side of an angle formed by the first portion and the second portion;

a second side wall portion that extends continuously from at least a portion of another side edge of the first portion to at least a portion of another side edge of the second portion, and protrudes toward the narrow angle side; and a mounting portion including a mounting surface that is provided on the second portion and faces a side opposite to the side to which the first side wall portion and the second side wall portion protrude, the first support body includes:

a first joining portion configured to be mounted on the mounting surface in the second step; and the second joining portion on which the board material is to be arranged directly or indirectly in the fourth step, the fastening member includes a first drill screw configured to fasten the mounting portion and the first joining portion to each other in a direction perpendicular to the mounting surface in the third step, in the second step, an extension member is arranged between the mounting portion of the bracket and the first joining portion of the first support body, the extension member includes:

an extension mounting portion that is configured to be mounted on the mounting surface, extends away from the first portion, and includes an extension mounting surface that faces the same side as the mounting surface and on which the first joining portion is to be mounted;

a first extension side wall portion that protrudes in the same direction as the first side wall portion from one side edge of the extension mounting portion, and is adjacent to the first side wall portion; and a second extension side wall portion that protrudes in the same direction as the second side wall portion from another side edge of the extension mounting portion, and is adjacent to the second side wall portion, in the third step, the fastening member fastens the mounting portion and the extension mounting portion to each other in a direction perpendicular to the mounting surface using a second drill screw, and the fastening member fastens the extension mounting portion and the first joining portion to each other in a direction perpendicular to the extension mounting surface using a third drill screw.

16. The board material construction method according to claim 15, wherein the extension mounting portion is provided with an auxiliary elongated hole that extends away from the first portion, and in the third step, the third drill screw is inserted into the auxiliary elongated hole and thereafter shallowly screwed into the first joining portion, then the first support body is positioned through shifting in the direction of moving away from the first portion or the opposite direction, and then the third drill screw is completely screwed into the first joining portion.

* * * * *